US010347267B2

(12) United States Patent
Wang

(10) Patent No.: US 10,347,267 B2
(45) **Date of Patent: *Jul. 9, 2019**

(54) AUDIO ENCODING METHOD AND APPARATUS

(71) Applicant: HUAWEI TECHNOLOGIES CO., LTD., Shenzhen, Guangdong (CN)

(72) Inventor: Zhe Wang, Beijing (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 0 days.

This patent is subject to a terminal disclaimer.

(21) Appl. No.: 15/682,097

(22) Filed: Aug. 21, 2017

(65) Prior Publication Data

US 2017/0345436 A1 Nov. 30, 2017

Related U.S. Application Data

(63) Continuation of application No. 15/386,246, filed on Dec. 21, 2016, now Pat. No. 9,761,239, which is a (Continued)

(30) Foreign Application Priority Data

Jun. 24, 2014 (CN) ..... 2014 1 0288983

(51) Int. Cl.
*G10L 19/02* (2013.01)
*G10L 19/04* (2013.01)
(Continued)

(52) U.S. Cl.
CPC ..... *G10L 19/22* (2013.01); *G10L 19/0204* (2013.01); *G10L 19/035* (2013.01);
(Continued)

(58) Field of Classification Search
CPC ..... G10L 19/20
See application file for complete search history.

(56) References Cited

U.S. PATENT DOCUMENTS 6,134,518 A * 10/2000 Cohen ..... G10L 19/18 704/201
6,647,366 B2 11/2003 Wang et al.
(Continued)

FOREIGN PATENT DOCUMENTS

CN 1969319 A 5/2007
CN 101025918 A 8/2007
(Continued)

OTHER PUBLICATIONS

Kos, M. et al., "Online Speech/Music Segmentation Based on the Variance Mean of Filter Bank Energy", EURASIP Journal on Advances in Signal Processing, vol. 2009, Article ID 628570, total 13 pages.
(Continued)

*Primary Examiner* — Jialong He
(74) *Attorney, Agent, or Firm* — Huawei Technologies Co., Ltd.

(57) ABSTRACT

An audio encoding method and an apparatus are provided. The method includes: determining sparseness of distribution, on spectrums, of energy of N input audio frames (101), where the N audio frames include a current audio frame, and N is a positive integer; and determining, according to the sparseness of distribution, on the spectrums, of the energy of the N audio frames, whether to use a first encoding method or a second encoding method to encode the current audio frame (102), where the first encoding method is an encoding method that is based on time-frequency transform and transform coefficient quantization and that is not based on linear prediction, and the second encoding method is a
(Continued)

linear-predication-based encoding method. The method can reduce encoding complexity and ensure that encoding is of relatively high accuracy.

20 Claims, 1 Drawing Sheet

Related U.S. Application Data continuation of application No. PCT/CN2015/082076, filed on Jun. 23, 2015.

(51) Int. Cl.

| | |
|---|---|
| ***G10L 19/22*** | (2013.01) |
| ***G10L 19/20*** | (2013.01) |
| ***G10L 19/035*** | (2013.01) |
| ***G10L 19/06*** | (2013.01) |
| *G10L 25/03* | (2013.01) |

(52) U.S. Cl.

CPC ..... *G10L 19/06* (2013.01); *G10L 19/20* (2013.01); *G10L 19/02* (2013.01); *G10L 19/04* (2013.01); *G10L 25/03* (2013.01)

(56) References Cited

U.S. PATENT DOCUMENTS

| | | | | |
|---|---|---|---|---|
| 7,139,700 | B1 | 11/2006 | Stachurski et al. | |
| 7,747,430 | B2 | 6/2010 | Makinen | |
| 8,015,000 | B2 | 9/2011 | Zopf et al. | |
| 8,244,525 | B2 | 8/2012 | Makinen | |
| 8,484,023 | B2 | 7/2013 | Kanevsky et al. | |
| 8,712,770 | B2 | 4/2014 | Fukuda et al. | |
| 2003/0004711 | A1 | 1/2003 | Koishida et al. | |
| 2003/0009325 | A1* | 1/2003 | Kirchherr | G10L 19/20 704/211 |
| 2005/0096898 | A1* | 5/2005 | Singhal | G10H 1/125 704/205 |
| 2005/0192798 | A1* | 9/2005 | Vainio | G10L 19/20 704/223 |
| 2005/0256701 | A1* | 11/2005 | Makinen | G10L 19/20 704/223 |
| 2006/0277039 | A1 | 12/2006 | Vos et al. | |
| 2008/0147414 | A1* | 6/2008 | Son | G10L 19/20 704/500 |
| 2008/0235033 | A1 | 9/2008 | Lee et al. | |
| 2009/0187409 | A1* | 7/2009 | Krishnan | G10L 19/20 704/262 |
| 2010/0063806 | A1* | 3/2010 | Gao | G10L 19/022 704/207 |
| 2010/0070272 | A1* | 3/2010 | Lee | G10L 19/20 704/219 |
| 2010/0070285 | A1* | 3/2010 | Kim | G10L 19/20 704/500 |
| 2010/0305955 | A1 | 12/2010 | Miao et al. | |
| 2011/0178796 | A1* | 7/2011 | Liu | G10L 25/81 704/205 |
| 2011/0202337 | A1* | 8/2011 | Fuchs | G10L 19/20 704/231 |
| 2012/0046955 | A1* | 2/2012 | Rajendran | G10L 19/028 704/500 |
| 2012/0128165 | A1 | 5/2012 | Visser et al. | |
| 2013/0096930 | A1* | 4/2013 | Neuendorf | G10L 19/008 704/500 |
| 2013/0114733 | A1 | 5/2013 | Fukui et al. | |
| 2013/0185063 | A1* | 7/2013 | Atti | G10L 17/02 704/219 |
| 2014/0046658 | A1* | 2/2014 | Grancharov | G10L 25/78 704/208 |

FOREIGN PATENT DOCUMENTS

| | | | |
|---|---|---|---|
| CN | 102419974 | A | 4/2012 |
| CN | 103280221 | A | 9/2013 |
| CN | 103778919 | A | 5/2014 |
| CN | 104217730 | A | 12/2014 |
| EP | 0932141 | A2 | 7/1999 |
| EP | 2139000 | A1 | 12/2009 |
| JP | 2010506239 | A | 2/2010 |
| JP | 2010522348 | A | 7/2010 |
| JP | 2011043795 | A | 3/2011 |
| KR | 20080097684 | A | 11/2008 |
| KR | 20130108391 | A | 10/2013 |
| RU | 2413191 | C2 | 2/2011 |
| WO | 9632823 | A1 | 10/1996 |
| WO | 2004082288 | A1 | 9/2004 |
| WO | 2008045846 | A1 | 4/2008 |
| WO | 2012005210 | A1 | 1/2012 |
| WO | 2012024379 | A2 | 2/2012 |

OTHER PUBLICATIONS

Carey, Michael J. et al., "A comparison of features for speech, music discrimination," Acoustics, Speech, and Signal Processing, 1999 IEEE International Conference vol. 1, IEEE, 1999, pp. 149-152.

Abdullah I. Al-Shoshan, "Speech and Music Classification and Separation: A Review", J. King Saud Univ.19, Eng. Sci. (1), 2006. pp. 95-133.

* cited by examiner

AUDIO ENCODING METHOD AND APPARATUS

CROSS-REFERENCE TO RELATED APPLICATIONS

This application is a continuation of U.S. patent application Ser. No. 15/386,246, filed on Dec. 21, 2016, which is a continuation of International Application No. PCT/CN2015/082076, filed on Jun. 23, 2015, which claims priority to Chinese Patent Application No. 201410288983.3, filed on Jun. 24, 2014, all of the afore-mentioned patent applications are hereby incorporated by reference in their entireties.

TECHNICAL FIELD

Embodiments of the present invention relate to the field of signal processing technologies, and more specifically, to an audio encoding method and an apparatus.

BACKGROUND

In the prior art, a hybrid encoder is usually used to encode an audio signal in a voice communications system. Specifically, the hybrid encoder usually includes two sub encoders. One sub encoder is suitable to encoding a speech signal, and the other sub encoder is suitable to encoding a non-speech signal. For a received audio signal, each sub encoder of the hybrid encoder encodes the audio signal. The hybrid encoder directly compares quality of encoded audio signals to select an optimum sub encoder. However, such a closed-loop encoding method has high operation complexity.

SUMMARY

Embodiments of the present invention provide an audio encoding method and an apparatus, which can reduce encoding complexity and ensure that encoding is of relatively high accuracy.

According to a first aspect, an audio encoding method is provided, where the method includes: determining sparseness of distribution, on spectrums, of energy of N input audio frames, where the N audio frames include a current audio frame, and N is a positive integer; and determining, according to the sparseness of distribution, on the spectrums, of the energy of the N audio frames, whether to use a first encoding method or a second encoding method to encode the current audio frame, where the first encoding method is an encoding method that is based on time-frequency transform and transform coefficient quantization and that is not based on linear prediction, and the second encoding method is a linear-predication-based encoding method.

With reference to the first aspect, in a first possible implementation manner of the first aspect, the determining sparseness of distribution, on spectrums, of energy of N input audio frames includes: dividing a spectrum of each of the N audio frames into P spectral envelopes, where P is a positive integer; and determining a general sparseness parameter according to energy of the P spectral envelopes of each of the N audio frames, where the general sparseness parameter indicates the sparseness of distribution, on the spectrums, of the energy of the N audio frames.

With reference to the first possible implementation manner of the first aspect, in a second possible implementation manner of the first aspect, the general sparseness parameter includes a first minimum bandwidth; the determining a general sparseness parameter according to energy of the P spectral envelopes of each of the N audio frames includes: determining an average value of minimum bandwidths of distribution, on the spectrums, of first-preset-proportion energy of the N audio frames according to the energy of the P spectral envelopes of each of the N audio frames, where the average value of the minimum bandwidths of distribution, on the spectrums, of the first-preset-proportion energy of the N audio frames is the first minimum bandwidth; and the determining, according to the sparseness of distribution, on the spectrums, of the energy of the N audio frames, whether to use a first encoding method or a second encoding method to encode the current audio frame includes: when the first minimum bandwidth is less than a first preset value, determining to use the first encoding method to encode the current audio frame; or when the first minimum bandwidth is greater than the first preset value, determining to use the second encoding method to encode the current audio frame.

With reference to the second possible implementation manner of the first aspect, in a third possible implementation manner of the first aspect, the determining an average value of minimum bandwidths of distribution, on the spectrums, of first-preset-proportion energy of the N audio frames according to the energy of the P spectral envelopes of each of the N audio frames includes: sorting the energy of the P spectral envelopes of each audio frame in descending order; determining, according to the energy, sorted in descending order, of the P spectral envelopes of each of the N audio frames, a minimum bandwidth of distribution, on the spectrum, of energy that accounts for not less than the first preset proportion of each of the N audio frames; and determining, according to the minimum bandwidth of distribution, on the spectrum, of the energy that accounts for not less than the first preset proportion of each of the N audio frames, an average value of minimum bandwidths of distribution, on the spectrums, of energy that accounts for not less than the first preset proportion of the N audio frames.

With reference to the first possible implementation manner of the first aspect, in a fourth possible implementation manner of the first aspect, the general sparseness parameter includes a first energy proportion; the determining a general sparseness parameter according to energy of the P spectral envelopes of each of the N audio frames includes: selecting $P_1$ spectral envelopes from the P spectral envelopes of each of the N audio frames; and determining the first energy proportion according to energy of the $P_1$ spectral envelopes of each of the N audio frames and total energy of the respective N audio frames, where $P_1$ is a positive integer less than P; and the determining, according to the sparseness of distribution, on the spectrums, of the energy of the N audio frames, whether to use a first encoding method or a second encoding method to encode the current audio frame includes: when the first energy proportion is greater than a second preset value, determining to use the first encoding method to encode the current audio frame; or when the first energy proportion is less than the second preset value, determining to use the second encoding method to encode the current audio frame.

With reference to the fourth possible implementation manner of the first aspect, in a fifth possible implementation manner of the first aspect, energy of any one of the $P_1$ spectral envelopes is greater than energy of any one of the other spectral envelopes in the P spectral envelopes except the $P_1$ spectral envelopes.

With reference to the first possible implementation manner of the first aspect, in a sixth possible implementation manner of the first aspect, the general sparseness parameter includes a second minimum bandwidth and a third minimum bandwidth; the determining a general sparseness parameter according to energy of the P spectral envelopes of each of the N audio frames includes: determining an average value of minimum bandwidths of distribution, on the spectrums, of second-preset-proportion energy of the N audio frames and determining an average value of minimum bandwidths of distribution, on the spectrums, of third-preset-proportion energy of the N audio frames according to the energy of the P spectral envelopes of each of the N audio frames, where the average value of the minimum bandwidths of distribution, on the spectrums, of the second-preset-proportion energy of the N audio frames is used as the second minimum bandwidth, the average value of the minimum bandwidths of distribution, on the spectrums, of the third-preset-proportion energy of the N audio frames is used as the third minimum bandwidth, and the second preset proportion is less than the third preset proportion; and the determining, according to the sparseness of distribution, on the spectrums, of the energy of the N audio frames, whether to use a first encoding method or a second encoding method to encode the current audio frame includes: when the second minimum bandwidth is less than a third preset value and the third minimum bandwidth is less than a fourth preset value, determining to use the first encoding method to encode the current audio frame; when the third minimum bandwidth is less than a fifth preset value, determining to use the first encoding method to encode the current audio frame; or when the third minimum bandwidth is greater than a sixth preset value, determining to use the second encoding method to encode the current audio frame, where the fourth preset value is greater than or equal to the third preset value, the fifth preset value is less than the fourth preset value, and the sixth preset value is greater than the fourth preset value.

With reference to the sixth possible implementation manner of the first aspect, in a seventh possible implementation manner of the first aspect, the determining an average value of minimum bandwidths of distribution, on the spectrums, of second-preset-proportion energy of the N audio frames and determining an average value of minimum bandwidths of distribution, on the spectrums, of third-preset-proportion energy of the N audio frames according to the energy of the P spectral envelopes of each of the N audio frames includes: sorting the energy of the P spectral envelopes of each audio frame in descending order; determining, according to the energy, sorted in descending order, of the P spectral envelopes of each of the N audio frames, a minimum bandwidth of distribution, on the spectrum, of energy that accounts for not less than the second preset proportion of each of the N audio frames; determining, according to the minimum bandwidth of distribution, on the spectrum, of the energy that accounts for not less than the second preset proportion of each of the N audio frames, an average value of minimum bandwidths of distribution, on the spectrums, of energy that accounts for not less than the second preset proportion of the N audio frames; determining, according to the energy, sorted in descending order, of the P spectral envelopes of each of the N audio frames, a minimum bandwidth of distribution, on the spectrum, of energy that accounts for not less than the third preset proportion of each of the N audio frames; and determining, according to the minimum bandwidth of distribution, on the spectrum, of the energy that accounts for not less than the third preset proportion of each of the N audio frames, an average value of minimum bandwidths of distribution, on the spectrums, of energy that accounts for not less than the third preset proportion of the N audio frames.

With reference to the first possible implementation manner of the first aspect, in an eighth possible implementation manner of the first aspect, the general sparseness parameter includes a second energy proportion and a third energy proportion; the determining a general sparseness parameter according to energy of the P spectral envelopes of each of the N audio frames includes: selecting $P_2$ spectral envelopes from the P spectral envelopes of each of the N audio frames; determining the second energy proportion according to energy of the $P_2$ spectral envelopes of each of the N audio frames and total energy of the respective N audio frames; selecting $P_3$ spectral envelopes from the P spectral envelopes of each of the N audio frames; and determining the third energy proportion according to energy of the $P_3$ spectral envelopes of each of the N audio frames and the total energy of the respective N audio frames, where $P_2$ and $P_3$ are positive integers less than P, and $P_2$ is less than $P_3$; and the determining, according to the sparseness of distribution, on the spectrums, of the energy of the N audio frames, whether to use a first encoding method or a second encoding method to encode the current audio frame includes: when the second energy proportion is greater than a seventh preset value and the third energy proportion is greater than an eighth preset value, determining to use the first encoding method to encode the current audio frame; when the second energy proportion is greater than a ninth preset value, determining to use the first encoding method to encode the current audio frame; or when the third energy proportion is less than a tenth preset value, determining to use the second encoding method to encode the current audio frame.

With reference to the eighth possible implementation manner of the first aspect, in a ninth possible implementation manner of the first aspect, the $P_2$ spectral envelopes are $P_2$ spectral envelopes having maximum energy in the P spectral envelopes; and the $P_3$ spectral envelopes are $P_3$ spectral envelopes having maximum energy in the P spectral envelopes.

With reference to the first aspect, in a tenth possible implementation manner of the first aspect, the sparseness of distribution of the energy on the spectrums includes global sparseness, local sparseness, and short-time burstiness of distribution of the energy on the spectrums.

With reference to the tenth possible implementation manner of the first aspect, in an eleventh possible implementation manner of the first aspect, N is 1, and the N audio frames are the current audio frame; and the determining sparseness of distribution, on spectrums, of energy of N input audio frames includes: dividing a spectrum of the current audio frame into Q sub bands; and determining a burst sparseness parameter according to peak energy of each of the Q sub bands of the spectrum of the current audio frame, where the burst sparseness parameter is used to indicate global sparseness, local sparseness, and short-time burstiness of the current audio frame.

With reference to the eleventh possible implementation manner of the first aspect, in a twelfth possible implementation manner of the first aspect, the burst sparseness parameter includes: a global peak-to-average proportion of each of the Q sub bands, a local peak-to-average proportion of each of the Q sub bands, and a short-time energy fluctuation of each of the Q sub bands, where the global peak-to-average proportion is determined according to the peak energy in the sub band and average energy of all the sub bands of the current audio frame, the local peak-to-average proportion is determined according to the peak energy in the sub band and average energy in the sub band, and the short-time peak energy fluctuation is determined according to the peak energy in the sub band and peak energy in a specific frequency band of an audio frame before the audio frame; and the determining, according to the sparseness of distribution, on the spectrums, of the energy of the N audio frames, whether to use a first encoding method or a second encoding method to encode the current audio frame includes: determining whether there is a first sub band in the Q sub bands, where a local peak-to-average proportion of the first sub band is greater than an eleventh preset value, a global peak-to-average proportion of the first sub band is greater than a twelfth preset value, and a short-time peak energy fluctuation of the first sub band is greater than a thirteenth preset value; and when there is the first sub band in the Q sub bands, determining to use the first encoding method to encode the current audio frame.

With reference to the first aspect, in a thirteenth possible implementation manner of the first aspect, the sparseness of distribution of the energy on the spectrums includes band-limited characteristics of distribution of the energy on the spectrums.

With reference to the thirteenth possible implementation manner of the first aspect, in a fourteenth possible implementation manner of the first aspect, the determining sparseness of distribution, on spectrums, of energy of N input audio frames includes: determining a demarcation frequency of each of the N audio frames; and determining a band-limited sparseness parameter according to the demarcation frequency of each of the N audio frames.

With reference to the fourteenth possible implementation manner of the first aspect, in a fifteenth possible implementation manner of the first aspect, the band-limited sparseness parameter is an average value of the demarcation frequencies of the N audio frames; and the determining, according to the sparseness of distribution, on the spectrums, of the energy of the N audio frames, whether to use a first encoding method or a second encoding method to encode the current audio frame includes: when it is determined that the band-limited sparseness parameter of the audio frames is less than a fourteenth preset value, determining to use the first encoding method to encode the current audio frame.

According to a second aspect, an embodiment of the present invention provides an apparatus, where the apparatus includes: an obtaining unit, configured to obtain N audio frames, where the N audio frames include a current audio frame, and N is a positive integer; and a determining unit, configured to determine sparseness of distribution, on the spectrums, of energy of the N audio frames obtained by the obtaining unit; and the determining unit is further configured to determine, according to the sparseness of distribution, on the spectrums, of the energy of the N audio frames, whether to use a first encoding method or a second encoding method to encode the current audio frame, where the first encoding method is an encoding method that is based on time-frequency transform and transform coefficient quantization and that is not based on linear prediction, and the second encoding method is a linear-predication-based encoding method.

With reference to the second aspect, in a first possible implementation manner of the second aspect, the determining unit is specifically configured to divide a spectrum of each of the N audio frames into P spectral envelopes, and determine a general sparseness parameter according to energy of the P spectral envelopes of each of the N audio frames, where P is a positive integer, and the general sparseness parameter indicates the sparseness of distribution, on the spectrums, of the energy of the N audio frames.

With reference to the first possible implementation manner of the second aspect, in a second possible implementation manner of the second aspect, the general sparseness parameter includes a first minimum bandwidth; the determining unit is specifically configured to determine an average value of minimum bandwidths of distribution, on the spectrums, of first-preset-proportion energy of the N audio frames according to the energy of the P spectral envelopes of each of the N audio frames, where the average value of the minimum bandwidths of distribution, on the spectrums, of the first-preset-proportion energy of the N audio frames is the first minimum bandwidth; and the determining unit is specifically configured to: when the first minimum bandwidth is less than a first preset value, determine to use the first encoding method to encode the current audio frame; and when the first minimum bandwidth is greater than the first preset value, determine to use the second encoding method to encode the current audio frame.

With reference to the second possible implementation manner of the second aspect, in a third possible implementation manner of the second aspect, the determining unit is specifically configured to: sort the energy of the P spectral envelopes of each audio frame in descending order; determine, according to the energy, sorted in descending order, of the P spectral envelopes of each of the N audio frames, a minimum bandwidth of distribution, on the spectrum, of energy that accounts for not less than the first preset proportion of each of the N audio frames; and determine, according to the minimum bandwidth of distribution, on the spectrum, of the energy that accounts for not less than the first preset proportion of each of the N audio frames, an average value of minimum bandwidths of distribution, on the spectrums, of energy that accounts for not less than the first preset proportion of the N audio frames.

With reference to the first possible implementation manner of the second aspect, in a fourth possible implementation manner of the second aspect, the general sparseness parameter includes a first energy proportion; the determining unit is specifically configured to select $P_1$ spectral envelopes from the P spectral envelopes of each of the N audio frames, and determine the first energy proportion according to energy of the $P_1$ spectral envelopes of each of the N audio frames and total energy of the respective N audio frames, where $P_1$ is a positive integer less than P; and the determining unit is specifically configured to: when the first energy proportion is greater than a second preset value, determine to use the first encoding method to encode the current audio frame; and when the first energy proportion is less than the second preset value, determine to use the second encoding method to encode the current audio frame.

With reference to the fourth possible implementation manner of the second aspect, in a fifth possible implementation manner of the second aspect, the determining unit is specifically configured to determine the $P_1$ spectral envelopes according to the energy of the P spectral envelopes, where energy of any one of the $P_1$ spectral envelopes is greater than energy of any one of the other spectral envelopes in the P spectral envelopes except the $P_1$ spectral envelopes.

With reference to the first possible implementation manner of the second aspect, in a sixth possible implementation manner of the second aspect, the general sparseness parameter includes a second minimum bandwidth and a third minimum bandwidth; the determining unit is specifically configured to determine an average value of minimum bandwidths of distribution, on the spectrums, of second-preset-proportion energy of the N audio frames and determine an average value of minimum bandwidths of distribution, on the spectrums, of third-preset-proportion energy of the N audio frames according to the energy of the P spectral envelopes of each of the N audio frames, where the average value of the minimum bandwidths of distribution, on the spectrums, of the second-preset-proportion energy of the N audio frames is used as the second minimum bandwidth, the average value of the minimum bandwidths of distribution, on the spectrums, of the third-preset-proportion energy of the N audio frames is used as the third minimum bandwidth, and the second preset proportion is less than the third preset proportion; and the determining unit is specifically configured to: when the second minimum bandwidth is less than a third preset value and the third minimum bandwidth is less than a fourth preset value, determine to use the first encoding method to encode the current audio frame; when the third minimum bandwidth is less than a fifth preset value, determine to use the first encoding method to encode the current audio frame; and when the third minimum bandwidth is greater than a sixth preset value, determine to use the second encoding method to encode the current audio frame, where the fourth preset value is greater than or equal to the third preset value, the fifth preset value is less than the fourth preset value, and the sixth preset value is greater than the fourth preset value.

With reference to the sixth possible implementation manner of the second aspect, in a seventh possible implementation manner of the second aspect, the determining unit is specifically configured to: sort the energy of the P spectral envelopes of each audio frame in descending order; determine, according to the energy, sorted in descending order, of the P spectral envelopes of each of the N audio frames, a minimum bandwidth of distribution, on the spectrum, of energy that accounts for not less than the second preset proportion of each of the N audio frames; determine, according to the minimum bandwidth of distribution, on the spectrum, of the energy that accounts for not less than the second preset proportion of each of the N audio frames, an average value of minimum bandwidths of distribution, on the spectrums, of energy that accounts for not less than the second preset proportion of the N audio frames; determine, according to the energy, sorted in descending order, of the P spectral envelopes of each of the N audio frames, a minimum bandwidth of distribution, on the spectrum, of energy that accounts for not less than the third preset proportion of each of the N audio frames; and determine, according to the minimum bandwidth of distribution, on the spectrum, of the energy that accounts for not less than the third preset proportion of each of the N audio frames, an average value of minimum bandwidths of distribution, on the spectrums, of energy that accounts for not less than the third preset proportion of the N audio frames.

With reference to the first possible implementation manner of the second aspect, in an eighth possible implementation manner of the second aspect, the general sparseness parameter includes a second energy proportion and a third energy proportion; the determining unit is specifically configured to: select $P_2$ spectral envelopes from the P spectral envelopes of each of the N audio frames, determine the second energy proportion according to energy of the $P_2$ spectral envelopes of each of the N audio frames and total energy of the respective N audio frames, select $P_3$ spectral envelopes from the P spectral envelopes of each of the N audio frames, and determine the third energy proportion according to energy of the $P_3$ spectral envelopes of each of the N audio frames and the total energy of the respective N audio frames, where $P_2$ and $P_3$ are positive integers less than P, and $P_2$ is less than $P_3$; and the determining unit is specifically configured to: when the second energy proportion is greater than a seventh preset value and the third energy proportion is greater than an eighth preset value, determine to use the first encoding method to encode the current audio frame; when the second energy proportion is greater than a ninth preset value, determine to use the first encoding method to encode the current audio frame; and when the third energy proportion is less than a tenth preset value, determine to use the second encoding method to encode the current audio frame.

With reference to the eighth possible implementation manner of the second aspect, in a ninth possible implementation manner of the second aspect, the determining unit is specifically configured to determine, from the P spectral envelopes of each of the N audio frames, $P_2$ spectral envelopes having maximum energy, and determine, from the P spectral envelopes of each of the N audio frames, $P_3$ spectral envelopes having maximum energy.

With reference to the second aspect, in a tenth possible implementation manner of the second aspect, N is 1, and the N audio frames are the current audio frame; and the determining unit is specifically configured to divide a spectrum of the current audio frame into Q sub bands, and determine a burst sparseness parameter according to peak energy of each of the Q sub bands of the spectrum of the current audio frame, where the burst sparseness parameter is used to indicate global sparseness, local sparseness, and short-time burstiness of the current audio frame.

With reference to the tenth possible implementation manner of the second aspect, in an eleventh possible implementation manner of the second aspect, the determining unit is specifically configured to determine a global peak-to-average proportion of each of the Q sub bands, a local peak-to-average proportion of each of the Q sub bands, and a short-time energy fluctuation of each of the Q sub bands, where the global peak-to-average proportion is determined by the determining unit according to the peak energy in the sub band and average energy of all the sub bands of the current audio frame, the local peak-to-average proportion is determined by the determining unit according to the peak energy in the sub band and average energy in the sub band, and the short-time peak energy fluctuation is determined according to the peak energy in the sub band and peak energy in a specific frequency band of an audio frame before the audio frame; and the determining unit is specifically configured to: determine whether there is a first sub band in the Q sub bands, where a local peak-to-average proportion of the first sub band is greater than an eleventh preset value, a global peak-to-average proportion of the first sub band is greater than a twelfth preset value, and a short-time peak energy fluctuation of the first sub band is greater than a thirteenth preset value; and when there is the first sub band in the Q sub bands, determine to use the first encoding method to encode the current audio frame.

With reference to the second aspect, in a twelfth possible implementation manner of the second aspect, the determining unit is specifically configured to determine a demarcation frequency of each of the N audio frames; and the determining unit is specifically configured to determine a band-limited sparseness parameter according to the demarcation frequency of each of the N audio frames.

With reference to the twelfth possible implementation manner of the second aspect, in a thirteenth possible implementation manner of the second aspect, the band-limited sparseness parameter is an average value of the demarcation frequencies of the N audio frames; and the determining unit is specifically configured to: when it is determined that the band-limited sparseness parameter of the audio frames is less than a fourteenth preset value, determine to use the first encoding method to encode the current audio frame.

According to the foregoing technical solutions, when an audio frame is encoded, sparseness of distribution, on a spectrum, of energy of the audio frame is considered, which can reduce encoding complexity and ensure that encoding is of relatively high accuracy.

BRIEF DESCRIPTION OF DRAWINGS

To describe the technical solutions in the embodiments of the present invention more clearly, the following briefly describes the accompanying drawings required for describing the embodiments of the present invention. Apparently, the accompanying drawings in the following description show merely some embodiments of the present invention, and a person of ordinary skill in the art may still derive other drawings from these accompanying drawings without creative efforts.

DESCRIPTION OF EMBODIMENTS

The following clearly describes the technical solutions in the embodiments of the present invention with reference to the accompanying drawings in the embodiments of the present invention. Apparently, the described embodiments are merely a part rather than all of the embodiments of the present invention. All other embodiments obtained by a person of ordinary skill in the art based on the embodiments of the present invention without creative efforts shall fall within the protection scope of the present invention.

Figure 1:
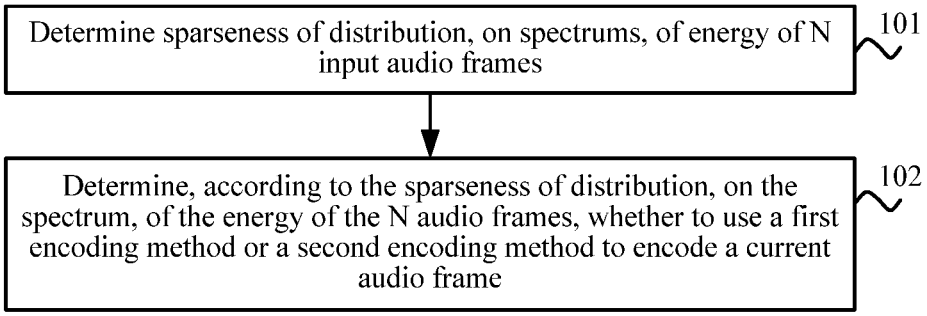
FIG. 1 is a schematic flowchart of an audio encoding method according to an embodiment of the present invention.

FIG. 1 is a schematic flowchart of an audio encoding method according to an embodiment of the present invention.

101: Determine sparseness of distribution, on spectrums, of energy of N input audio frames, where the N audio frames include a current audio frame, and N is a positive integer.

102: Determine, according to the sparseness of distribution, on the spectrums, of the energy of the N audio frames, whether to use a first encoding method or a second encoding method to encode the current audio frame, where the first encoding method is an encoding method that is based on time-frequency transform and transform coefficient quantization and that is not based on linear prediction, and the second encoding method is a linear-predication-based encoding method.

According to the method shown in FIG. 1, when an audio frame is encoded, sparseness of distribution, on a spectrum, of energy of the audio frame is considered, which can reduce encoding complexity and ensure that encoding is of relatively high accuracy.

During selection of an appropriate encoding method for an audio frame, sparseness of distribution, on a spectrum, of energy of the audio frame may be considered. There may be three types of sparseness of distribution, on a spectrum, of energy of an audio frame: general sparseness, burst sparseness, and band-limited sparseness.

Optionally, in an embodiment, an appropriate encoding method may be selected for the current audio frame by using the general sparseness. In this case, the determining sparseness of distribution, on spectrums, of energy of N input audio frames includes: dividing a spectrum of each of the N audio frames into P spectral envelopes, where P is a positive integer; and determining a general sparseness parameter according to energy of the P spectral envelopes of each of the N audio frames, where the general sparseness parameter indicates the sparseness of distribution, on the spectrums, of the energy of the N audio frames.

Specifically, an average value of minimum bandwidths, distributed on spectrums, of specific-proportion energy of N input consecutive audio frames may be defined as the general sparseness. A smaller bandwidth indicates stronger general sparseness, and a larger bandwidth indicates weaker general sparseness. In other words, stronger general sparseness indicates that energy of an audio frame is more centralized, and weaker general sparseness indicates that energy of an audio frame is more disperse. Efficiency is high when the first encoding method is used to encode an audio frame whose general sparseness is relatively strong. Therefore, an appropriate encoding method may be selected by determining general sparseness of an audio frame, to encode the audio frame. To help determine general sparseness of an audio frame, the general sparseness may be quantized to obtain a general sparseness parameter. Optionally, when N is 1, the general sparseness is a minimum bandwidth of distribution, on a spectrum, of specific-proportion energy of the current audio frame.

Optionally, in an embodiment, the general sparseness parameter includes a first minimum bandwidth. In this case, the determining a general sparseness parameter according to energy of the P spectral envelopes of each of the N audio frames includes: determining an average value of minimum bandwidths of distribution, on the spectrums, of first-preset-proportion energy of the N audio frames according to the energy of the P spectral envelopes of each of the N audio frames, where the average value of the minimum bandwidths of distribution, on the spectrums, of the first-preset-proportion energy of the N audio frames is the first minimum bandwidth. The determining, according to the sparseness of distribution, on the spectrums, of the energy of the N audio frames, whether to use a first encoding method or a second encoding method to encode the current audio frame includes: when the first minimum bandwidth is less than a first preset value, determining to use the first encoding method to encode the current audio frame; or when the first minimum bandwidth is greater than the first preset value, determining to use the second encoding method to encode the current audio frame. Optionally, in an embodiment, when N is 1, the N audio frames are the current audio frame, and the average value of the minimum bandwidths of distribution, on the spectrums, of the first-preset-proportion energy of the N audio frames is a minimum bandwidth of distribution, on the spectrum, of first-preset-proportion energy of the current audio frame.

A person skilled in the art may understand that, the first preset value and the first preset proportion may be determined according to a simulation experiment. An appropriate first preset value and first preset proportion may be determined by means of a simulation experiment, so that a good encoding effect can be obtained when an audio frame meeting the foregoing condition is encoded by using the first encoding method or the second encoding method. Generally, a value of the first preset proportion is generally a number between 0 and 1 and relatively close to 1, for example, 90% or 80%. The selection of the first preset value is related to the value of the first preset proportion, and also related to a selection tendency between the first encoding method and the second encoding method. For example, a first preset value corresponding to a relatively large first preset proportion is generally greater than a first preset value corresponding to a relatively small first preset proportion. For another example, a first preset value corresponding to a tendency to select the first encoding method is generally greater than a first preset value corresponding to a tendency to select the second encoding method.

The determining an average value of minimum bandwidths of distribution, on the spectrums, of first-preset-proportion energy of the N audio frames according to the energy of the P spectral envelopes of each of the N audio frames includes: sorting the energy of the P spectral envelopes of each audio frame in descending order; determining, according to the energy, sorted in descending order, of the P spectral envelopes of each of the N audio frames, a minimum bandwidth of distribution, on the spectrum, of energy that accounts for not less than the first preset proportion of each of the N audio frames; and determining, according to the minimum bandwidth of distribution, on the spectrum, of the energy that accounts for not less than the first preset proportion of each of the N audio frames, an average value of minimum bandwidths of distribution, on the spectrums, of energy that accounts for not less than the first preset proportion of the N audio frames. For example, an input audio signal is a wideband signal sampled at 16 kHz, and the input signal is input in a frame of 20 ms. Each frame of signal is 320 time domain sampling points. Time-frequency transform is performed on a time domain signal. For example, time-frequency transform is performed by means of fast Fourier transform (FFT), to obtain 160 spectral envelopes S(k), that is, 160 FFT energy spectrum coefficients, where k=0, 1, 2, . . . , 159. A minimum bandwidth is found from the spectral envelopes S(k) in a manner that a proportion that energy on the bandwidth accounts for in total energy of the frame is the first preset proportion. Specifically, determining a minimum bandwidth of distribution, on a spectrum, of first-preset-proportion energy of an audio frame according to energy, sorted in descending order, of P spectral envelopes of the audio frame includes: sequentially accumulating energy of frequency bins in the spectral envelopes S(k) in descending order; and comparing energy obtained after each time of accumulation with the total energy of the audio frame, and if a proportion is greater than the first preset proportion, ending the accumulation process, where a quantity of times of accumulation is the minimum bandwidth. For example, the first preset proportion is 90%, and if a proportion that an energy sum obtained after 30 times of accumulation accounts for in the total energy exceeds 90%, a proportion that an energy sum obtained after 29 times of accumulation accounts for in the total energy is less than 90%, and a proportion that an energy sum obtained after 31 times of accumulation accounts for in the total energy exceeds the proportion that the energy sum obtained after 30 times of accumulation accounts for in the total energy, it may be considered that a minimum bandwidth of distribution, on the spectrum, of energy that accounts for not less than the first preset proportion of the audio frame is 30. The foregoing minimum bandwidth determining process is executed for each of the N audio frames, to separately determine the minimum bandwidths of distribution, on the spectrums, of the energy that accounts for not less than the first preset proportion of the N audio frames including the current audio frame, and calculate the average value of the N minimum bandwidths. The average value of the N minimum bandwidths may be referred to as the first minimum bandwidth, and the first minimum bandwidth may be used as the general sparseness parameter. When the first minimum bandwidth is less than the first preset value, it is determined to use the first encoding method to encode the current audio frame. When the first minimum bandwidth is greater than the first preset value, it is determined to use the second encoding method to encode the current audio frame.

Optionally, in another embodiment, the general sparseness parameter may include a first energy proportion. In this case, the determining a general sparseness parameter according to energy of the P spectral envelopes of each of the N audio frames includes: selecting $P_1$ spectral envelopes from the P spectral envelopes of each of the N audio frames; and determining the first energy proportion according to energy of the $P_1$ spectral envelopes of each of the N audio frames and total energy of the respective N audio frames, where $P_1$ is a positive integer less than P. The determining, according to the sparseness of distribution, on the spectrums, of the energy of the N audio frames, whether to use a first encoding method or a second encoding method to encode the current audio frame includes: when the first energy proportion is greater than a second preset value, determining to use the first encoding method to encode the current audio frame; or when the first energy proportion is less than the second preset value, determining to use the second encoding method to encode the current audio frame. Optionally, in an embodiment, when N is 1, the N audio frames are the current audio frame, and the determining the first energy proportion according to energy of the $P_1$ spectral envelopes of each of the N audio frames and total energy of the respective N audio frames includes: determining the first energy proportion according to energy of $P_1$ spectral envelopes of the current audio frame and total energy of the current audio frame.

Specifically, the first energy proportion may be calculated by using the following formula:

$$\begin{cases} R_1 = \dfrac{\sum_{n=1}^{N} r(n)}{N} \\ r(n) = \dfrac{E_{p1}(n)}{E_{all}(n)} \end{cases} \quad \text{Formula 1.1}$$

where $R_1$ represents the first energy proportion, $E_{p1}(n)$ represents an energy sum of $P_1$ selected spectral envelopes in an $n^{th}$ audio frame, $E_{all}(n)$ represents total energy of the $n^{th}$ audio frame, and r(n) represents a proportion that the energy of the $P_1$ spectral envelopes of the $n^{th}$ audio frame in the N audio frames accounts for in the total energy of the audio frame.

A person skilled in the art may understand that, the second preset value and selection of the $P_1$ spectral envelopes may be determined according to a simulation experiment. An appropriate second preset value, an appropriate value of $P_1$, and an appropriate method for selecting the $P_1$ spectral envelopes may be determined by means of a simulation experiment, so that a good encoding effect can be obtained when an audio frame meeting the foregoing condition is encoded by using the first encoding method or the second encoding method. Generally, the value of $P_1$ may be a relatively small number. For example, $P_1$ is selected in a manner that a proportion of $P_1$ to P is less than 20%. For the second preset value, a number corresponding to an excessively small proportion is generally not selected. For example, a number less than 10% is not selected. The selection of the second preset value is related to the value of $P_1$ and a selection tendency between the first encoding method and the second encoding method. For example, a second preset value corresponding to relatively large $P_1$ is generally greater than a second preset value corresponding to relatively small $P_1$. For another example, a second preset value corresponding to a tendency to select the first encoding method is generally less than a second preset value corresponding to a tendency to select the second encoding method. Optionally, in an embodiment, energy of any one of the $P_1$ spectral envelopes is greater than energy of any one of the remaining $(P-P_1)$ spectral envelopes in the P spectral envelopes.

For example, an input audio signal is a wideband signal sampled at 16 kHz, and the input signal is input in a frame of 20 ms. Each frame of signal is 320 time domain sampling points. Time-frequency transform is performed on a time domain signal. For example, time-frequency transform is performed by means of fast Fourier transform, to obtain 160 spectral envelopes S(k), where k=0, 1, 2, . . . , 159. $P_1$ spectral envelopes are selected from the 160 spectral envelopes, and a proportion that an energy sum of the $P_1$ spectral envelopes accounts for in total energy of the audio frame is calculated. The foregoing process is executed for each of the N audio frames. That is, a proportion that an energy sum of the $P_1$ spectral envelopes of each of the N audio frames accounts for in respective total energy is calculated. An average value of the proportions is calculated. The average value of the proportions is the first energy proportion. When the first energy proportion is greater than the second preset value, it is determined to use the first encoding method to encode the current audio frame. When the first energy proportion is less than the second preset value, it is determined to use the second encoding method to encode the current audio frame. Energy of any one of the $P_1$ spectral envelopes is greater than energy of any one of the other spectral envelopes in the P spectral envelopes except the $P_1$ spectral envelopes. Optionally, in an embodiment, the value of $P_1$ may be 20.

Optionally, in another embodiment, the general sparseness parameter may include a second minimum bandwidth and a third minimum bandwidth. In this case, the determining a general sparseness parameter according to energy of the P spectral envelopes of each of the N audio frames includes: determining an average value of minimum bandwidths of distribution, on the spectrums, of second-preset-proportion energy of the N audio frames and determining an average value of minimum bandwidths of distribution, on the spectrums, of third-preset-proportion energy of the N audio frames according to the energy of the P spectral envelopes of each of the N audio frames, where the average value of the minimum bandwidths of distribution, on the spectrums, of the second-preset-proportion energy of the N audio frames is used as the second minimum bandwidth, the average value of the minimum bandwidths of distribution, on the spectrums, of the third-preset-proportion energy of the N audio frames is used as the third minimum bandwidth, and the second preset proportion is less than the third preset proportion. The determining, according to the sparseness of distribution, on the spectrums, of the energy of the N audio frames, whether to use a first encoding method or a second encoding method to encode the current audio frame includes: when the second minimum bandwidth is less than a third preset value and the third minimum bandwidth is less than a fourth preset value, determining to use the first encoding method to encode the current audio frame; when the third minimum bandwidth is less than a fifth preset value, determining to use the first encoding method to encode the current audio frame; or when the third minimum bandwidth is greater than a sixth preset value, determining to use the second encoding method to encode the current audio frame. The fourth preset value is greater than or equal to the third preset value, the fifth preset value is less than the fourth preset value, and the sixth preset value is greater than the fourth preset value. Optionally, in an embodiment, when N is 1, the N audio frames are the current audio frame. The determining an average value of minimum bandwidths of distribution, on the spectrums, of second-preset-proportion energy of the N audio frames as the second minimum bandwidth includes: determining a minimum bandwidth of distribution, on the spectrum, of second-preset-proportion energy of the current audio frame as the second minimum bandwidth. The determining an average value of minimum bandwidths of distribution, on the spectrums, of third-preset-proportion energy of the N audio frames as the third minimum bandwidth includes: determining a minimum bandwidth of distribution, on the spectrum, of third-preset-proportion energy of the current audio frame as the third minimum bandwidth.

A person skilled in the art may understand that, the third preset value, the fourth preset value, the fifth preset value, the sixth preset value, the second preset proportion, and the third preset proportion may be determined according to a simulation experiment. Appropriate preset values and preset proportions may be determined by means of a simulation experiment, so that a good encoding effect can be obtained when an audio frame meeting the foregoing condition is encoded by using the first encoding method or the second encoding method.

The determining an average value of minimum bandwidths of distribution, on the spectrums, of second-preset-proportion energy of the N audio frames and determining an average value of minimum bandwidths of distribution, on the spectrums, of third-preset-proportion energy of the N audio frames according to the energy of the P spectral envelopes of each of the N audio frames includes: sorting the energy of the P spectral envelopes of each audio frame in descending order; determining, according to the energy, sorted in descending order, of the P spectral envelopes of each of the N audio frames, a minimum bandwidth of distribution, on the spectrum, of energy that accounts for not less than the second preset proportion of each of the N audio frames; determining, according to the minimum bandwidth of distribution, on the spectrum, of the energy that accounts for not less than the second preset proportion of each of the N audio frames, an average value of minimum bandwidths of distribution, on the spectrums, of energy that accounts for not less than the second preset proportion of the N audio frames; determining, according to the energy, sorted in descending order, of the P spectral envelopes of each of the N audio frames, a minimum bandwidth of distribution, on the spectrum, of energy that accounts for not less than the third preset proportion of each of the N audio frames; and determining, according to the minimum bandwidth of distribution, on the spectrum, of the energy that accounts for not less than the third preset proportion of each of the N audio frames, an average value of minimum bandwidths of distribution, on the spectrums, of energy that accounts for not less than the third preset proportion of the N audio frames. For example, an input audio signal is a wideband signal sampled at 16 kHz, and the input signal is input in a frame of 20 ms. Each frame of signal is 320 time domain sampling points. Time-frequency transform is performed on a time domain signal. For example, time-frequency transform is performed by means of fast Fourier transform, to obtain 160 spectral envelopes S(k), where k=0, 1, 2, . . . , 159. A minimum bandwidth is found from the spectral envelopes S(k) in a manner that a proportion that energy on the bandwidth accounts for in total energy of the frame is the second preset proportion. A bandwidth continues to be found from the spectral envelopes S(k) in a manner that a proportion that energy on the bandwidth accounts for in the total energy is the third preset proportion. Specifically, determining, according to energy, sorted in descending order, of P spectral envelopes of the audio frame, a minimum bandwidth of distribution, on a spectrum, of energy that accounts for not less than the second preset proportion of an audio frame and a minimum bandwidth of distribution, on the spectrum, of energy that accounts for not less than the third preset proportion of the audio frame includes: sequentially accumulating energy of frequency bins in the spectral envelopes S(k) in descending order. Energy obtained after each time of accumulation is compared with total energy of the audio frame, and if a proportion is greater than the second preset proportion, a quantity of times of accumulation is a minimum bandwidth that meets being not less than the second preset proportion. The accumulation is continued, and if a proportion of energy obtained after accumulation to the total energy of the audio frame is greater than the third preset proportion, the accumulation is ended, and a quantity of times of accumulation is a minimum bandwidth that meets being not less than the third preset proportion. For example, the second preset proportion is 85%, and the third preset proportion is 95%. If a proportion that an energy sum obtained after 30 times of accumulation accounts for in the total energy exceeds 85%, it may be considered that the minimum bandwidth of distribution, on the spectrum, of the second-preset-proportion energy of the audio frame is 30. The accumulation is continued, and if a proportion that an energy sum obtained after 35 times of accumulation accounts for in the total energy is 95%, it may be considered that the minimum bandwidth of distribution, on the spectrum, of the third-preset-proportion energy of the audio frame is 35. The foregoing process is executed for each of the N audio frames, to separately determine the minimum bandwidths of distribution, on the spectrums, of the energy that accounts for not less than the second preset proportion of the N audio frames including the current audio frame and the minimum bandwidths of distribution, on the spectrums, of the energy that accounts for not less than the third preset proportion of the N audio frames including the current audio frame. The average value of the minimum bandwidths of distribution, on the spectrums, of the energy that accounts for not less than the second preset proportion of the N audio frames is the second minimum bandwidth. The average value of the minimum bandwidths of distribution, on the spectrums, of the energy that accounts for not less than the third preset proportion of the N audio frames is the third minimum bandwidth. When the second minimum bandwidth is less than the third preset value and the third minimum bandwidth is less than the fourth preset value, it is determined to use the first encoding method to encode the current audio frame. When the third minimum bandwidth is less than the fifth preset value, it is determined to use the first encoding method to encode the current audio frame. When the third minimum bandwidth is greater than the sixth preset value, it is determined to use the second encoding method to encode the current audio frame.

Optionally, in another embodiment, the general sparseness parameter includes a second energy proportion and a third energy proportion. In this case, the determining a general sparseness parameter according to energy of the P spectral envelopes of each of the N audio frames includes: selecting $P_2$ spectral envelopes from the P spectral envelopes of each of the N audio frames; determining the second energy proportion according to energy of the $P_2$ spectral envelopes of each of the N audio frames and total energy of the respective N audio frames; selecting $P_3$ spectral envelopes from the P spectral envelopes of each of the N audio frames; and determining the third energy proportion according to energy of the $P_3$ spectral envelopes of each of the N audio frames and the total energy of the respective N audio frames. The determining, according to the sparseness of distribution, on the spectrums, of the energy of the N audio frames, whether to use a first encoding method or a second encoding method to encode the current audio frame includes: when the second energy proportion is greater than a seventh preset value and the third energy proportion is greater than an eighth preset value, determining to use the first encoding method to encode the current audio frame; when the second energy proportion is greater than a ninth preset value, determining to use the first encoding method to encode the current audio frame; or when the third energy proportion is less than a tenth preset value, determining to use the second encoding method to encode the current audio frame. $P_2$ and $P_3$ are positive integers less than P, and $P_2$ is less than $P_3$. Optionally, in an embodiment, when N is 1, the N audio frames are the current audio frame. The determining the second energy proportion according to energy of the $P_2$ spectral envelopes of each of the N audio frames and total energy of the respective N audio frames includes: determining the second energy proportion according to energy of $P_2$ spectral envelopes of the current audio frame and total energy of the current audio frame. The determining the third energy proportion according to energy of the $P_3$ spectral envelopes of each of the N audio frames and the total energy of the respective N audio frames includes: determining the third energy proportion according to energy of $P_3$ spectral envelopes of the current audio frame and the total energy of the current audio frame.

A person skilled in the art may understand that, values of $P_2$ and $P_3$, the seventh preset value, the eighth preset value, the ninth preset value, and the tenth preset value may be determined according to a simulation experiment. Appropriate preset values may be determined by means of a simulation experiment, so that a good encoding effect can be obtained when an audio frame meeting the foregoing condition is encoded by using the first encoding method or the second encoding method. Optionally, in an embodiment, the $P_2$ spectral envelopes may be $P_2$ spectral envelopes having maximum energy in the P spectral envelopes; and the $P_3$ spectral envelopes may be $P_3$ spectral envelopes having maximum energy in the P spectral envelopes.

For example, an input audio signal is a wideband signal sampled at 16 kHz, and the input signal is input in a frame of 20 ms. Each frame of signal is 320 time domain sampling points. Time-frequency transform is performed on a time domain signal. For example, time-frequency transform is performed by means of fast Fourier transform, to obtain 160 spectral envelopes S(k), where k=0, 1, 2, . . . , 159. $P_2$ spectral envelopes are selected from the 160 spectral envelopes, and a proportion that an energy sum of the $P_2$ spectral envelopes accounts for in total energy of the audio frame is calculated. The foregoing process is executed for each of the N audio frames. That is, a proportion that an energy sum of the $P_2$ spectral envelopes of each of the N audio frames accounts for in respective total energy is calculated. An average value of the proportions is calculated. The average value of the proportions is the second energy proportion. $P_3$ spectral envelopes are selected from the 160 spectral envelopes, and a proportion that an energy sum of the $P_3$ spectral envelopes accounts for in the total energy of the audio frame is calculated. The foregoing process is executed for each of the N audio frames. That is, a proportion that an energy sum of the $P_3$ spectral envelopes of each of the N audio frames accounts for in the respective total energy is calculated. An average value of the proportions is calculated. The average value of the proportions is the third energy proportion. When the second energy proportion is greater than the seventh preset value and the third energy proportion is greater than the eighth preset value, it is determined to use the first encoding method to encode the current audio frame. When the second energy proportion is greater than the ninth preset value, it is determined to use the first encoding method to encode the current audio frame. When the third energy proportion is less than the tenth preset value, it is determined to use the second encoding method to encode the current audio frame. The $P_2$ spectral envelopes may be $P_2$ spectral envelopes having maximum energy in the P spectral envelopes; and the $P_3$ spectral envelopes may be $P_3$ spectral envelopes having maximum energy in the P spectral envelopes. Optionally, in an embodiment, the value of $P_2$ may be 20, and the value of $P_3$ may be 30.

Optionally, in another embodiment, an appropriate encoding method may be selected for the current audio frame by using the burst sparseness. For the burst sparseness, global sparseness, local sparseness, and short-time burstiness of distribution, on a spectrum, of energy of an audio frame need to be considered. In this case, the sparseness of distribution of the energy on the spectrums may include global sparseness, local sparseness, and short-time burstiness of distribution of the energy on the spectrums. In this case, a value of N may be 1, and the N audio frames are the current audio frame. The determining sparseness of distribution, on spectrums, of energy of N input audio frames includes: dividing a spectrum of the current audio frame into Q sub bands; and determining a burst sparseness parameter according to peak energy of each of the Q sub bands of the spectrum of the current audio frame, where the burst sparseness parameter is used to indicate global sparseness, local sparseness, and short-time burstiness of the current audio frame. The burst sparseness parameter includes: a global peak-to-average proportion of each of the Q sub bands, a local peak-to-average proportion of each of the Q sub bands, and a short-time energy fluctuation of each of the Q sub bands, where the global peak-to-average proportion is determined according to the peak energy in the sub band and average energy of all the sub bands of the current audio frame, the local peak-to-average proportion is determined according to the peak energy in the sub band and average energy in the sub band, and the short-time peak energy fluctuation is determined according to the peak energy in the sub band and peak energy in a specific frequency band of an audio frame before the audio frame. The determining, according to the sparseness of distribution, on the spectrums, of the energy of the N audio frames, whether to use a first encoding method or a second encoding method to encode the current audio frame includes: determining whether there is a first sub band in the Q sub bands, where a local peak-to-average proportion of the first sub band is greater than an eleventh preset value, a global peak-to-average proportion of the first sub band is greater than a twelfth preset value, and a short-time peak energy fluctuation of the first sub band is greater than a thirteenth preset value; and when there is the first sub band in the Q sub bands, determining to use the first encoding method to encode the current audio frame. The global peak-to-average proportion of each of the Q sub bands, the local peak-to-average proportion of each of the Q sub bands, and the short-time energy fluctuation of each of the Q sub bands respectively represent the global sparseness, the local sparseness, and the short-time burstiness.

Specifically, the global peak-to-average proportion may be determined by using the following formula:

$$p2s(i) = e(i)/\left(\frac{1}{P} * \sum_{k=0}^{P-1} s(k)\right) \quad \text{Formula 1.2}$$

where e(i) represents peak energy of an $i^{th}$ sub band in the Q sub bands, s(k) represents energy of a $k^{th}$ spectral envelope in the P spectral envelopes, and p2s(i) represents a global peak-to-average proportion of the $i^{th}$ sub band.

The local peak-to-average proportion may be determined by using the following formula:

$$p2a(i) = e(i)/\left(\frac{1}{h(i) - 1(i) + 1} * \sum_{k=1(i)}^{h(i)} s(k)\right) \quad \text{Formula 1.3}$$

where e(i) represents the peak energy of the $i^{th}$ sub band in the Q sub bands, s(k) represents the energy of the $k^{th}$ spectral envelope in the P spectral envelopes, h(i) represents an index of a spectral envelope that is included in the $i^{th}$ sub band and that has a highest frequency, l(i) represents an index of a spectral envelope that is included in the $i^{th}$ sub band and that has a lowest frequency, p2a(i) represents a local peak-to-average proportion of the $i^{th}$ sub band, and h(i) is less than or equal to P−1.

The short-time peak energy fluctuation may be determined by using the following formula:

$$dev(i)=(2*e(i))/(e_1+e_2) \quad \text{Formula 1.4}$$

where e(i) represents the peak energy of the $i^{th}$ sub band in the Q sub bands of the current audio frame, and $e_1$ and $e_2$ represent peak energy of specific frequency bands of audio frames before the current audio frame. Specifically, assuming that the current audio frame is an $M^{th}$ audio frame, a spectral envelope in which peak energy of the $i^{th}$ sub band of the current audio frame is located is determined. It is assumed that the spectral envelope in which the peak energy is located is $i_1$. Peak energy within a range from an $(i_1-t)^{th}$ spectral envelope to an $(i_1+t)^{th}$ spectral envelope in an $(M-1)^{th}$ audio frame is determined, and the peak energy is $e_1$. Similarly, peak energy within a range from an $(i_1-t)^{th}$ spectral envelope to an $(i_1+t)^{th}$ spectral envelope in an $(M-2)^{th}$ audio frame is determined, and the peak energy is $e_2$.

A person skilled in the art may understand that, the eleventh preset value, the twelfth preset value, and the thirteenth preset value may be determined according to a simulation experiment. Appropriate preset values may be determined by means of a simulation experiment, so that a good encoding effect can be obtained when an audio frame meeting the foregoing condition is encoded by using the first encoding method.

Optionally, in another embodiment, an appropriate encoding method may be selected for the current audio frame by using the band-limited sparseness. In this case, the sparseness of distribution of the energy on the spectrums includes band-limited sparseness of distribution of the energy on the spectrums. In this case, the determining sparseness of distribution, on spectrums, of energy of N input audio frames includes: determining a demarcation frequency of each of the N audio frames; and determining a band-limited sparseness parameter according to the demarcation frequency of each N audio frame. The band-limited sparseness parameter may be an average value of the demarcation frequencies of the N audio frames. For example, an $N_i^{th}$ audio frame is any one of the N audio frames, and a frequency range of the $N_i^{th}$ audio frame is from $F_b$ to $F_e$, where $F_b$ is less than $F_e$. Assuming that a start frequency is $F_b$, a method for determining a demarcation frequency of the $N_i^{th}$ audio frame may be searching for a frequency $F_s$ by starting from $F_b$, where $F_s$ meets the following conditions: a proportion of an energy sum from $F_b$ to $F_s$ to total energy of the $N_i^{th}$ audio frame is not less than a fourth preset proportion, and a proportion of an energy sum from $F_b$ to any frequency less than $F_s$ to the total energy of the $N_i^{th}$ audio frame is less than the fourth preset proportion, where $F_s$ is the demarcation frequency of the $N_i^{th}$ audio frame. The foregoing demarcation frequency determining step is performed for each of the N audio frames. In this way, the N demarcation frequencies of the N audio frames may be obtained. The determining, according to the sparseness of distribution, on the spectrums, of the energy of the N audio frames, whether to use a first encoding method or a second encoding method to encode the current audio frame includes: when it is determined that the band-limited sparseness parameter of the audio frames is less than a fourteenth preset value, determining to use the first encoding method to encode the current audio frame.

A person skilled in the art may understand that, the fourth preset proportion and the fourteenth preset value may be determined according to a simulation experiment. An appropriate preset value and preset proportion may be determined according to a simulation experiment, so that a good encoding effect can be obtained when an audio frame meeting the foregoing condition is encoded by using the first encoding method. Generally, a number less than 1 but close to 1, for example, 95% or 99%, is selected as a value of the fourth preset proportion. For the selection of the fourteenth preset value, a number corresponding to a relatively high frequency is generally not selected. For example, in some embodiments, if a frequency range of an audio frame is 0 Hz to 8 kHz, a number less than a frequency of 5 kHz may be selected as the fourteenth preset value.

For example, energy of each of P spectral envelopes of the current audio frame may be determined, and a demarcation frequency is searched for from a low frequency to a high frequency in a manner that a proportion that energy that is less than the demarcation frequency accounts for in total energy of the current audio frame is the fourth preset proportion. Assuming that N is 1, the demarcation frequency of the current audio frame is the band-limited sparseness parameter. Assuming that N is an integer greater than 1, it is determined that the average value of the demarcation frequencies of the N audio frames is the band-limited sparseness parameter. A person skilled in the art may understand that, the demarcation frequency determining mentioned above is merely an example. Alternatively, the demarcation frequency determining method may be searching for a demarcation frequency from a high frequency to a low frequency or may be another method.

Further, to avoid frequent switching between the first encoding method and the second encoding method, a hangover period may be further set. For an audio frame in the hangover period, an encoding method used for an audio frame at a start position of the hangover period may be used. In this way, a switching quality decrease caused by frequent switching between different encoding methods can be avoided.

If a hangover length of the hangover period is L, L audio frames after the current audio frame all belong to a hangover period of the current audio frame. If sparseness of distribution, on a spectrum, of energy of an audio frame belonging the hangover period is different from sparseness of distribution, on a spectrum, of energy of an audio frame at a start position of the hangover period, the audio frame is still encoded by using an encoding method that is the same as that used for the audio frame at the start position of the hangover period.

The hangover period length may be updated according to sparseness of distribution, on a spectrum, of energy of an audio frame in the hangover period, until the hangover period length is 0.

For example, if it is determined to use the first encoding method for an $I^{th}$ audio frame and a length of a preset hangover period is L, the first encoding method is used for an $(I+1)^{th}$ audio frame to an $(I+L)^{th}$ audio frame. Then, sparseness of distribution, on a spectrum, of energy of the $(I+1)^{th}$ audio frame is determined, and the hangover period is re-calculated according to the sparseness of distribution, on the spectrum, of the energy of the $(I+1)^{th}$ audio frame. If the $(I+1)^{th}$ audio frame still meets a condition of using the first encoding method, a subsequent hangover period is still the preset hangover period L. That is, the hangover period starts from an $(L+2)^{th}$ audio frame to an $(I+1+L)^{th}$ audio frame. If the $(I+1)^{th}$ audio frame does not meet the condition of using the first encoding method, the hangover period is re-determined according to the sparseness of distribution, on the spectrum, of the energy of the $(I+1)^{th}$ audio frame. For example, it is re-determined that the hangover period is L−L1, where L1 is a positive integer less than or equal to L. If L1 is equal to L, the hangover period length is updated to 0. In this case, the encoding method is re-determined according to the sparseness of distribution, on the spectrum, of the energy of the $(I+1)^{th}$ audio frame. If L1 is an integer less than L, the encoding method is re-determined according to sparseness of distribution, on a spectrum, of energy of an $(I+1+L-L1)^{th}$ audio frame. However, because the $(I+1)^{th}$ audio frame is in a hangover period of the $I^{th}$ audio frame, the $(I+1)^{th}$ audio frame is still encoded by using the first encoding method. L1 may be referred to as a hangover update parameter, and a value of the hangover update parameter may be determined according to sparseness of distribution, on a spectrum, of energy of an input audio frame. In this way, hangover period update is related to sparseness of distribution, on a spectrum, of energy of an audio frame.

For example, when a general sparseness parameter is determined and the general sparseness parameter is a first minimum bandwidth, the hangover period may be re-determined according to a minimum bandwidth of distribution, on a spectrum, of first-preset-proportion energy of an audio frame. It is assumed that it is determined to use the first encoding method to encode the $I^{th}$ audio frame, and a preset hangover period is L. A minimum bandwidth of distribution, on a spectrum, of first-preset-proportion energy of each of H consecutive audio frames including the $(I+1)^{th}$ audio frame is determined, where H is a positive integer greater than 0.

If the $(I+1)^{th}$ audio frame does not meet the condition of using the first encoding method, a quantity of audio frames whose minimum bandwidths, distributed on spectrums, of first-preset-proportion energy are less than a fifteenth preset value (the quantity is briefly referred to as a first hangover parameter) is determined. When a minimum bandwidth of distribution, on a spectrum, of first-preset-proportion energy of an $(L+1)^{th}$ audio frame is greater than a sixteenth preset value and is less than a seventeenth preset value, and the first hangover parameter is less than an eighteenth preset value, the hangover period length is subtracted by 1, that is, the hangover update parameter is 1. The sixteenth preset value is greater than the first preset value. When the minimum bandwidth of distribution, on the spectrum, of the first-preset-proportion energy of the $(L+1)^{th}$ audio frame is greater than the seventeenth preset value and is less than a nineteenth preset value, and the first hangover parameter is less than the eighteenth preset value, the hangover period length is subtracted by 2, that is, the hangover update parameter is 2. When the minimum bandwidth of distribution, on the spectrum, of the first-preset-proportion energy of the $(L+1)^{th}$ audio frame is greater than the nineteenth preset value, the hangover period is set to 0. When the first hangover parameter and the minimum bandwidth of distribution, on the spectrum, of the first-preset-proportion energy of the $(L+1)^{th}$ audio frame do not meet one or more of the sixteenth preset value to the nineteenth preset value, the hangover period remains unchanged.

A person skilled in the art may understand that, the preset hangover period may be set according to an actual status, and the hangover update parameter also may be adjusted according to an actual status. The fifteenth preset value to the nineteenth preset value may be adjusted according to an actual status, so that different hangover periods may be set.

Similarly, when the general sparseness parameter includes a second minimum bandwidth and a third minimum bandwidth, or the general sparseness parameter includes a first energy proportion, or the general sparseness parameter includes a second energy proportion and a third energy proportion, a corresponding preset hangover period, a corresponding hangover update parameter, and a related parameter used to determine the hangover update parameter may be set, so that a corresponding hangover period can be determined, and frequent switching between encoding methods is avoided.

When the encoding method is determined according to the burst sparseness (that is, the encoding method is determined according to global sparseness, local sparseness, and short-time burstiness of distribution, on a spectrum, of energy of an audio frame), a corresponding hangover period, a corresponding hangover update parameter, and a related parameter used to determine the hangover update parameter may be set, to avoid frequent switching between encoding methods. In this case, the hangover period may be less than the hangover period that is set in the case of the general sparseness parameter.

When the encoding method is determined according to a band-limited characteristic of distribution of energy on a spectrum, a corresponding hangover period, a corresponding hangover update parameter, and a related parameter used to determine the hangover update parameter may be set, to avoid frequent switching between encoding methods. For example, a proportion of energy of a low spectral envelope of an input audio frame to energy of all spectral envelopes may be calculated, and the hangover update parameter is determined according to the proportion. Specifically, the proportion of the energy of the low spectral envelope to the energy of all the spectral envelopes may be determined by using the following formula:

$$R_{low} = \frac{\sum_{k=0}^{y} s(k)}{\sum_{k=0}^{P-1} s(k)} \quad \text{Formula 1.5}$$

where $R_{low}$ represents the proportion of the energy of the low spectral envelope to the energy of all the spectral envelopes, s(k) represents energy of a $k^{th}$ spectral envelope, y represents an index of a highest spectral envelope of a low frequency band, and P indicates that the audio frame is divided into P spectral envelopes in total. In this case, if $R_{low}$ is greater than a twentieth preset value, the hangover update parameter is 0. Otherwise, if $R_{low}$ is greater than a twenty-first preset value, the hangover update parameter may have a relatively small value, where the twentieth preset value is greater than the twenty-first preset value. If $R_{low}$ is not greater than the twenty-first preset value, the hangover parameter may have a relatively large value. A person skilled in the art may understand that, the twentieth preset value and the twenty-first preset value may be determined according to a simulation experiment, and the value of the hangover update parameter also may be determined according to an experiment. Generally, a number that is an excessively small proportion is generally not selected as the twenty-first preset value. For example, a number greater than 50% may be generally selected. The twentieth preset value ranges between the twenty-first preset value and 1.

In addition, when the encoding method is determined according to a band-limited characteristic of distribution of energy on a spectrum, a demarcation frequency of an input audio frame may be further determined, and the hangover update parameter is determined according to the demarcation frequency, where the demarcation frequency may be different from a demarcation frequency used to determine a band-limited sparseness parameter. If the demarcation frequency is less than a twenty-second preset value, the hangover update parameter is 0. Otherwise, if the demarcation frequency is less than a twenty-third preset value, the hangover update parameter has a relatively small value. The twenty-third preset value is greater than the twenty-second preset value. If the demarcation frequency is greater than the twenty-third preset value, the hangover update parameter may have a relatively large value. A person skilled in the art may understand that, the twenty-second preset value and the twenty-third preset value may be determined according to a simulation experiment, and the value of the hangover update parameter also may be determined according to an experiment. Generally, a number corresponding to a relatively high frequency is not selected as the twenty-third preset value. For example, if a frequency range of an audio frame is 0 Hz to 8 kHz, a number less than a frequency of 5 kHz may be selected as the twenty-third preset value.

Figure 2:
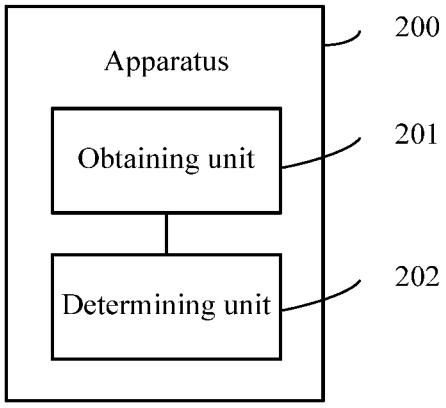
FIG. 2 is a structural block diagram of an apparatus according to an embodiment of the present invention.

FIG. 2 is a structural block diagram of an apparatus according to an embodiment of the present invention. The apparatus 200 shown in FIG. 2 can perform the steps in FIG. 1. As shown in FIG. 2, the apparatus 200 includes an obtaining unit 201 and a determining unit 202.

The obtaining unit 201 is configured to obtain N audio frames, where the N audio frames include a current audio frame, and N is a positive integer.

The determining unit 202 is configured to determine sparseness of distribution, on the spectrums, of energy of the N audio frames obtained by the obtaining unit 201.

The determining unit 202 is further configured to determine, according to the sparseness of distribution, on the spectrums, of the energy of the N audio frames, whether to use a first encoding method or a second encoding method to encode the current audio frame, where the first encoding method is an encoding method that is based on time-frequency transform and transform coefficient quantization and that is not based on linear prediction, and the second encoding method is a linear-predication-based encoding method.

According to the apparatus shown in FIG. 2, when an audio frame is encoded, sparseness of distribution, on a spectrum, of energy of the audio frame is considered, which can reduce encoding complexity and ensure that encoding is of relatively high accuracy.

During selection of an appropriate encoding method for an audio frame, sparseness of distribution, on a spectrum, of energy of the audio frame may be considered. There may be three types of sparseness of distribution, on a spectrum, of energy of an audio frame: general sparseness, burst sparseness, and band-limited sparseness.

Optionally, in an embodiment, an appropriate encoding method may be selected for the current audio frame by using the general sparseness. In this case, the determining unit 202 is specifically configured to divide a spectrum of each of the N audio frames into P spectral envelopes, and determine a general sparseness parameter according to energy of the P spectral envelopes of each of the N audio frames, where P is a positive integer, and the general sparseness parameter indicates the sparseness of distribution, on the spectrums, of the energy of the N audio frames.

Specifically, an average value of minimum bandwidths, distributed on spectrums, of specific-proportion energy of N input consecutive audio frames may be defined as the general sparseness. A smaller bandwidth indicates stronger general sparseness, and a larger bandwidth indicates weaker general sparseness. In other words, stronger general sparseness indicates that energy of an audio frame is more centralized, and weaker general sparseness indicates that energy of an audio frame is more disperse. Efficiency is high when the first encoding method is used to encode an audio frame whose general sparseness is relatively strong. Therefore, an appropriate encoding method may be selected by determining general sparseness of an audio frame, to encode the audio frame. To help determine general sparseness of an audio frame, the general sparseness may be quantized to obtain a general sparseness parameter. Optionally, when N is 1, the general sparseness is a minimum bandwidth of distribution, on a spectrum, of specific-proportion energy of the current audio frame.

Optionally, in an embodiment, the general sparseness parameter includes a first minimum bandwidth. In this case, the determining unit 202 is specifically configured to determine an average value of minimum bandwidths of distribution, on the spectrums, of first-preset-proportion energy of the N audio frames according to the energy of the P spectral envelopes of each of the N audio frames, where the average value of the minimum bandwidths of distribution, on the spectrums, of the first-preset-proportion energy of the N audio frames is the first minimum bandwidth. The determining unit 202 is specifically configured to: when the first minimum bandwidth is less than a first preset value, determine to use the first encoding method to encode the current audio frame; and when the first minimum bandwidth is greater than the first preset value, determine to use the second encoding method to encode the current audio frame.

A person skilled in the art may understand that, the first preset value and the first preset proportion may be determined according to a simulation experiment. An appropriate first preset value and first preset proportion may be determined by means of a simulation experiment, so that a good encoding effect can be obtained when an audio frame meeting the foregoing condition is encoded by using the first encoding method or the second encoding method.

The determining unit 202 is specifically configured to: sort the energy of the P spectral envelopes of each audio frame in descending order; determine, according to the energy, sorted in descending order, of the P spectral envelopes of each of the N audio frames, a minimum bandwidth of distribution, on the spectrum, of energy that accounts for not less than the first preset proportion of each of the N audio frames; and determine, according to the minimum bandwidth of distribution, on the spectrum, of the energy that accounts for not less than the first preset proportion of each of the N audio frames, an average value of minimum bandwidths of distribution, on the spectrums, of energy that accounts for not less than the first preset proportion of the N audio frames. For example, an audio signal obtained by the obtaining unit 201 is a wideband signal sampled at 16 kHz, and the obtained audio signal is obtained in a frame of 20 ms. Each frame of signal is 320 time domain sampling points. The determining unit 202 may perform time-frequency transform on a time domain signal, for example, perform time-frequency transform by means of fast Fourier transform (Fast Fourier Transformation, FFT), to obtain 160 spectral envelopes S(k), that is, 160 FFT energy spectrum coefficients, where k=0, 1, 2, . . . , 159. The determining unit 202 may find a minimum bandwidth from the spectral envelopes S(k) in a manner that a proportion that energy on the bandwidth accounts for in total energy of the frame is the first preset proportion. Specifically, the determining unit 202 may sequentially accumulate energy of frequency bins in the spectral envelopes S(k) in descending order; and compare energy obtained after each time of accumulation with the total energy of the audio frame, and if a proportion is greater than the first preset proportion, end the accumulation process, where a quantity of times of accumulation is the minimum bandwidth. For example, the first preset proportion is 90%, and if a proportion that an energy sum obtained after 30 times of accumulation accounts for in the total energy exceeds 90%, it may be considered that a minimum bandwidth of energy that accounts for not less than the first preset proportion of the audio frame is 30. The determining unit 202 may execute the foregoing minimum bandwidth determining process for each of the N audio frames, to separately determine the minimum bandwidths of the energy that accounts for not less than the first preset proportion of the N audio frames including the current audio frame. The determining unit 202 may calculate an average value of the minimum bandwidths of the energy that accounts for not less than the first preset proportion of the N audio frames. The average value of the minimum bandwidths of the energy that accounts for not less than the first preset proportion of the N audio frames may be referred to as the first minimum bandwidth, and the first minimum bandwidth may be used as the general sparseness parameter. When the first minimum bandwidth is less than the first preset value, the determining unit 202 may determine to use the first encoding method to encode the current audio frame. When the first minimum bandwidth is greater than the first preset value, the determining unit 202 may determine to use the second encoding method to encode the current audio frame.

Optionally, in another embodiment, the general sparseness parameter may include a first energy proportion. In this case, the determining unit 202 is specifically configured to select $P_1$ spectral envelopes from the P spectral envelopes of each of the N audio frames, and determine the first energy proportion according to energy of the $P_1$ spectral envelopes of each of the N audio frames and total energy of the respective N audio frames, where $P_1$ is a positive integer less than P. The determining unit 202 is specifically configured to: when the first energy proportion is greater than a second preset value, determine to use the first encoding method to encode the current audio frame; and when the first energy proportion is less than the second preset value, determine to use the second encoding method to encode the current audio frame. Optionally, in an embodiment, when N is 1, the N audio frames are the current audio frame, and the determining unit 202 is specifically configured to determine the first energy proportion according to energy of $P_1$ spectral envelopes of the current audio frame and total energy of the current audio frame. The determining unit 202 is specifically configured to determine the $P_1$ spectral envelopes according to the energy of the P spectral envelopes, where energy of any one of the $P_1$ spectral envelopes is greater than energy of any one of the other spectral envelopes in the P spectral envelopes except the $P_1$ spectral envelopes.

Specifically, the determining unit 202 may calculate the first energy proportion by using the following formula:

$$\begin{cases} R_1 = \dfrac{\sum_{n=1}^{N} r(n)}{N} \\ r(n) = \dfrac{E_{p1}(n)}{E_{all}(n)} \end{cases} \quad \text{Formula 1.6}$$

where $R_1$ represents the first energy proportion, $E_{p1}(n)$ represents an energy sum of $P_1$ selected spectral envelopes in an $n^{th}$ audio frame, $E_{all}(n)$ represents total energy of the $n^{th}$ audio frame, and r(n) represents a proportion that the energy of the $P_1$ spectral envelopes of the $n^{th}$ audio frame in the N audio frames accounts for in the total energy of the audio frame.

A person skilled in the art may understand that, the second preset value and selection of the $P_1$ spectral envelopes may be determined according to a simulation experiment. An appropriate second preset value, an appropriate value of $P_1$, and an appropriate method for selecting the $P_1$ spectral envelopes may be determined by means of a simulation experiment, so that a good encoding effect can be obtained when an audio frame meeting the foregoing condition is encoded by using the first encoding method or the second encoding method. Optionally, in an embodiment, the $P_1$ spectral envelopes may be $P_1$ spectral envelopes having maximum energy in the P spectral envelopes.

For example, an audio signal obtained by the obtaining unit 201 is a wideband signal sampled at 16 kHz, and the obtained audio signal is obtained in a frame of 20 ms. Each frame of signal is 320 time domain sampling points. The determining unit 202 may perform time-frequency transform on a time domain signal, for example, perform time-frequency transform by means of fast Fourier transform, to obtain 160 spectral envelopes S(k), where k=0, 1, 2, . . . , 159. The determining unit 202 may select $P_1$ spectral envelopes from the 160 spectral envelopes, and calculate a proportion that an energy sum of the $P_1$ spectral envelopes accounts for in total energy of the audio frame. The determining unit 202 may execute the foregoing process for each of the N audio frames, that is, calculate a proportion that an energy sum of the $P_1$ spectral envelopes of each of the N audio frames accounts for in respective total energy. The determining unit 202 may calculate an average value of the proportions. The average value of the proportions is the first energy proportion. When the first energy proportion is greater than the second preset value, the determining unit 202 may determine to use the first encoding method to encode the current audio frame. When the first energy proportion is less than the second preset value, the determining unit 202 may determine to use the second encoding method to encode the current audio frame. The $P_1$ spectral envelopes may be $P_1$ spectral envelopes having maximum energy in the P spectral envelopes. That is, the determining unit 202 is specifically configured to determine, from the P spectral envelopes of each of the N audio frames, $P_1$ spectral envelopes having maximum energy. Optionally, in an embodiment, the value of $P_1$ may be 20.

Optionally, in another embodiment, the general sparseness parameter may include a second minimum bandwidth and a third minimum bandwidth. In this case, the determining unit 202 is specifically configured to determine an average value of minimum bandwidths of distribution, on the spectrums, of second-preset-proportion energy of the N audio frames and determine an average value of minimum bandwidths of distribution, on the spectrums, of third-preset-proportion energy of the N audio frames according to the energy of the P spectral envelopes of each of the N audio frames, where the average value of the minimum bandwidths of distribution, on the spectrums, of the second-preset-proportion energy of the N audio frames is used as the second minimum bandwidth, the average value of the minimum bandwidths of distribution, on the spectrums, of the third-preset-proportion energy of the N audio frames is used as the third minimum bandwidth, and the second preset proportion is less than the third preset proportion. The determining unit 202 is specifically configured to: when the second minimum bandwidth is less than a third preset value and the third minimum bandwidth is less than a fourth preset value, determine to use the first encoding method to encode the current audio frame; when the third minimum bandwidth is less than a fifth preset value, determine to use the first encoding method to encode the current audio frame; and when the third minimum bandwidth is greater than a sixth preset value, determine to use the second encoding method to encode the current audio frame. Optionally, in an embodiment, when N is 1, the N audio frames are the current audio frame. The determining unit 202 may determine a minimum bandwidth of distribution, on the spectrum, of second-preset-proportion energy of the current audio frame as the second minimum bandwidth. The determining unit 202 may determine a minimum bandwidth of distribution, on the spectrum, of third-preset-proportion energy of the current audio frame as the third minimum bandwidth.

A person skilled in the art may understand that, the third preset value, the fourth preset value, the fifth preset value, the sixth preset value, the second preset proportion, and the third preset proportion may be determined according to a simulation experiment. Appropriate preset values and preset proportions may be determined by means of a simulation experiment, so that a good encoding effect can be obtained when an audio frame meeting the foregoing condition is encoded by using the first encoding method or the second encoding method.

The determining unit 202 is specifically configured to: sort the energy of the P spectral envelopes of each audio frame in descending order; determine, according to the energy, sorted in descending order, of the P spectral envelopes of each of the N audio frames, a minimum bandwidth of distribution, on the spectrum, of energy that accounts for not less than the second preset proportion of each of the N audio frames; determine, according to the minimum bandwidth of distribution, on the spectrum, of the energy that accounts for not less than the second preset proportion of each of the N audio frames, an average value of minimum bandwidths of distribution, on the spectrums, of energy that accounts for not less than the second preset proportion of the N audio frames; determine, according to the energy, sorted in descending order, of the P spectral envelopes of each of the N audio frames, a minimum bandwidth of distribution, on the spectrum, of energy that accounts for not less than the third preset proportion of each of the N audio frames; and determine, according to the minimum bandwidth of distribution, on the spectrum, of the energy that accounts for not less than the third preset proportion of each of the N audio frames, an average value of minimum bandwidths of distribution, on the spectrums, of energy that accounts for not less than the third preset proportion of the N audio frames. For example, an audio signal obtained by the obtaining unit 201 is a wideband signal sampled at 16 kHz, and the obtained audio signal is obtained in a frame of 20 ms. Each frame of signal is 320 time domain sampling points. The determining unit 202 may perform time-frequency transform on a time domain signal, for example, perform time-frequency transform by means of fast Fourier transform, to obtain 160 spectral envelopes S(k), where k=0, 1, 2, . . . , 159. The determining unit 202 may find a minimum bandwidth from the spectral envelopes S(k) in a manner that a proportion that energy on the bandwidth accounts for in total energy of the frame is not less than the second preset proportion. The determining unit 202 may continue to find a bandwidth from the spectral envelopes S(k) in a manner that a proportion that energy on the bandwidth accounts for in the total energy is not less than the third preset proportion. Specifically, the determining unit 202 may sequentially accumulate energy of frequency bins in the spectral envelopes S(k) in descending order. Energy obtained after each time of accumulation is compared with the total energy of the audio frame, and if a proportion is greater than the second preset proportion, a quantity of times of accumulation is a minimum bandwidth that is not less than the second preset proportion. The determining unit 202 may continue the accumulation. If a proportion of energy obtained after accumulation to the total energy of the audio frame is greater than the third preset proportion, the accumulation is ended, and a quantity of times of accumulation is a minimum bandwidth that is not less than the third preset proportion. For example, the second preset proportion is 85%, and the third preset proportion is 95%. If a proportion that an energy sum obtained after 30 times of accumulation accounts for in the total energy exceeds 85%, it may be considered that the minimum bandwidth of distribution, on the spectrum, of the energy that accounts for not less than the second preset proportion of the audio frame is 30. The accumulation is continued, and if a proportion that an energy sum obtained after 35 times of accumulation accounts for in the total energy is 95%, it may be considered that the minimum bandwidth of distribution, on the spectrum, of the energy that accounts for not less than the third preset proportion of the audio frame is 35. The determining unit 202 may execute the foregoing process for each of the N audio frames. The determining unit 202 may separately determine the minimum bandwidths of distribution, on the spectrums, of the energy that accounts for not less than the second preset proportion of the N audio frames including the current audio frame and the minimum bandwidths of distribution, on the spectrums, of the energy that accounts for not less than the third preset proportion of the N audio frames including the current audio frame. The average value of the minimum bandwidths of distribution, on the spectrums, of the energy that accounts for not less than the second preset proportion of the N audio frames is the second minimum bandwidth. The average value of the minimum bandwidths of distribution, on the spectrums, of the energy that accounts for not less than the third preset proportion of the N audio frames is the third minimum bandwidth. When the second minimum bandwidth is less than the third preset value and the third minimum bandwidth is less than the fourth preset value, the determining unit 202 may determine to use the first encoding method to encode the current audio frame. When the third minimum bandwidth is less than the fifth preset value, the determining unit 202 may determine to use the first encoding method to encode the current audio frame. When the third minimum bandwidth is greater than the first preset value, the determining unit 202 may determine to use the second encoding method to encode the current audio frame.

Optionally, in another embodiment, the general sparseness parameter includes a second energy proportion and a third energy proportion. In this case, the determining unit 202 is specifically configured to: select $P_2$ spectral envelopes from the P spectral envelopes of each of the N audio frames, determine the second energy proportion according to energy of the $P_2$ spectral envelopes of each of the N audio frames and total energy of the respective N audio frames, select $P_3$ spectral envelopes from the P spectral envelopes of each of the N audio frames, and determine the third energy proportion according to energy of the $P_3$ spectral envelopes of each of the N audio frames and the total energy of the respective N audio frames, where $P_2$ and $P_3$ are positive integers less than P, and $P_2$ is less than $P_3$. The determining unit 202 is specifically configured to: when the second energy proportion is greater than a seventh preset value and the third energy proportion is greater than an eighth preset value, determine to use the first encoding method to encode the current audio frame; when the second energy proportion is greater than a ninth preset value, determine to use the first encoding method to encode the current audio frame; and when the third energy proportion is less than a tenth preset value, determine to use the second encoding method to encode the current audio frame. Optionally, in an embodiment, when N is 1, the N audio frames are the current audio frame. The determining unit 202 may determine the second energy proportion according to energy of $P_2$ spectral envelopes of the current audio frame and total energy of the current audio frame. The determining unit 202 may determine the third energy proportion according to energy of $P_3$ spectral envelopes of the current audio frame and the total energy of the current audio frame.

A person skilled in the art may understand that, values of $P_2$ and $P_3$, the seventh preset value, the eighth preset value, the ninth preset value, and the tenth preset value may be determined according to a simulation experiment. Appropriate preset values may be determined by means of a simulation experiment, so that a good encoding effect can be obtained when an audio frame meeting the foregoing condition is encoded by using the first encoding method or the second encoding method. Optionally, in an embodiment, the determining unit 202 is specifically configured to determine, from the P spectral envelopes of each of the N audio frames, $P_2$ spectral envelopes having maximum energy, and determine, from the P spectral envelopes of each of the N audio frames, $P_3$ spectral envelopes having maximum energy.

For example, an audio signal obtained by the obtaining unit 201 is a wideband signal sampled at 16 kHz, and the obtained audio signal is obtained in a frame of 20 ms. Each frame of signal is 320 time domain sampling points. The determining unit 202 may perform time-frequency transform on a time domain signal, for example, perform time-frequency transform by means of fast Fourier transform, to obtain 160 spectral envelopes S(k), where k=0, 1, 2, . . . , 159. The determining unit 202 may select $P_2$ spectral envelopes from the 160 spectral envelopes, and calculate a proportion that an energy sum of the $P_2$ spectral envelopes accounts for in total energy of the audio frame. The determining unit 202 may execute the foregoing process for each of the N audio frames, that is, calculate a proportion that an energy sum of the $P_2$ spectral envelopes of each of the N audio frames accounts for in respective total energy. The determining unit 202 may calculate an average value of the proportions. The average value of the proportions is the second energy proportion. The determining unit 202 may select $P_3$ spectral envelopes from the 160 spectral envelopes, and calculate a proportion that an energy sum of the $P_3$ spectral envelopes accounts for in the total energy of the audio frame. The determining unit 202 may execute the foregoing process for each of the N audio frames, that is, calculate a proportion that an energy sum of the $P_3$ spectral envelopes of each of the N audio frames accounts for in the respective total energy. The determining unit 202 may calculate an average value of the proportions. The average value of the proportions is the third energy proportion. When the second energy proportion is greater than the seventh preset value and the third energy proportion is greater than the eighth preset value, the determining unit 202 may determine to use the first encoding method to encode the current audio frame. When the second energy proportion is greater than the ninth preset value, the determining unit 202 may determine to use the first encoding method to encode the current audio frame. When the third energy proportion is less than the tenth preset value, the determining unit 202 may determine to use the second encoding method to encode the current audio frame. The $P_2$ spectral envelopes may be $P_2$ spectral envelopes having maximum energy in the P spectral envelopes; and the $P_3$ spectral envelopes may be $P_3$ spectral envelopes having maximum energy in the P spectral envelopes. Optionally, in an embodiment, the value of $P_2$ may be 20, and the value of $P_3$ may be 30.

Optionally, in another embodiment, an appropriate encoding method may be selected for the current audio frame by using the burst sparseness. For the burst sparseness, global sparseness, local sparseness, and short-time burstiness of distribution, on a spectrum, of energy of an audio frame need to be considered. In this case, the sparseness of distribution of the energy on the spectrums may include global sparseness, local sparseness, and short-time burstiness of distribution of the energy on the spectrums. In this case, a value of N may be 1, and the N audio frames are the current audio frame. The determining unit 202 is specifically configured to divide a spectrum of the current audio frame into Q sub bands, and determine a burst sparseness parameter according to peak energy of each of the Q sub bands of the spectrum of the current audio frame, where the burst sparseness parameter is used to indicate global sparseness, local sparseness, and short-time burstiness of the current audio frame.

Specifically, the determining unit 202 is specifically configured to determine a global peak-to-average proportion of each of the Q sub bands, a local peak-to-average proportion of each of the Q sub bands, and a short-time energy fluctuation of each of the Q sub bands, where the global peak-to-average proportion is determined by the determining unit 202 according to the peak energy in the sub band and average energy of all the sub bands of the current audio frame, the local peak-to-average proportion is determined by the determining unit 202 according to the peak energy in the sub band and average energy in the sub band, and the short-time peak energy fluctuation is determined according to the peak energy in the sub band and peak energy in a specific frequency band of an audio frame before the audio frame. The global peak-to-average proportion of each of the Q sub bands, the local peak-to-average proportion of each of the Q sub bands, and the short-time energy fluctuation of each of the Q sub bands respectively represent the global sparseness, the local sparseness, and the short-time burstiness. The determining unit 202 is specifically configured to: determine whether there is a first sub band in the Q sub bands, where a local peak-to-average proportion of the first sub band is greater than an eleventh preset value, a global peak-to-average proportion of the first sub band is greater than a twelfth preset value, and a short-time peak energy fluctuation of the first sub band is greater than a thirteenth preset value; and when there is the first sub band in the Q sub bands, determine to use the first encoding method to encode the current audio frame.

Specifically, the determining unit 202 may calculate the global peak-to-average proportion by using the following formula:

$$p2s(i) = e(i)\Big/\left(\frac{1}{P} * \sum_{k=0}^{P-1} s(k)\right) \qquad \text{Formula 1.7}$$

where e(i) represents peak energy of an $i^{th}$ sub band in the Q sub bands, s(k) represents energy of a $k^{th}$ spectral envelope in the P spectral envelopes, and p2s(i) represents a global peak-to-average proportion of the $i^{th}$ sub band.

The determining unit 202 may calculate the local peak-to-average proportion by using the following formula:

$$p2a(i) = e(i)\Big/\left(\frac{1}{h(i) - 1(i) + 1} * \sum_{k=1(i)}^{h(i)} s(k)\right) \qquad \text{Formula 1.8}$$

where e(i) represents the peak energy of the $i^{th}$ sub band in the Q sub bands, s(k) represents the energy of the $k^{th}$ spectral envelope in the P spectral envelopes, h(i) represents an index of a spectral envelope that is included in the $i^{th}$ sub band and that has a highest frequency, l(i) represents an index of a spectral envelope that is included in the $i^{th}$ sub band and that has a lowest frequency, p2a(i) represents a local peak-to-average proportion of the $i^{th}$ sub band, and h(i) is less than or equal to P−1.

The determining unit 202 may calculate the short-time peak energy fluctuation by using the following formula:

$$dev(i)=(2*e(i))/(e_1+e_2) \qquad \text{Formula 1.9}$$

where e(i) represents the peak energy of the $i^{th}$ sub band in the Q sub bands of the current audio frame, and $e_1$ and $e_2$ represent peak energy of specific frequency bands of audio frames before the current audio frame. Specifically, assuming that the current audio frame is an $M^{th}$ audio frame, a spectral envelope in which peak energy of the $i^{th}$ sub band of the current audio frame is located is determined. It is assumed that the spectral envelope in which the peak energy is located is $i_1$. Peak energy within a range from an $(i_1-t)^{th}$ spectral envelope to an $(i_1+t)^{th}$ spectral envelope in an $(M-1)^{th}$ audio frame is determined, and the peak energy is $e_1$. Similarly, peak energy within a range from an $(i_1-t)^{th}$ spectral envelope to an $(i_1+t)^{th}$ spectral envelope in an $(M-2)^{th}$ audio frame is determined, and the peak energy is $e_2$.

A person skilled in the art may understand that, the eleventh preset value, the twelfth preset value, and the thirteenth preset value may be determined according to a simulation experiment. Appropriate preset values may be determined by means of a simulation experiment, so that a good encoding effect can be obtained when an audio frame meeting the foregoing condition is encoded by using the first encoding method.

Optionally, in another embodiment, an appropriate encoding method may be selected for the current audio frame by using the band-limited sparseness. In this case, the sparseness of distribution of the energy on the spectrums includes band-limited sparseness of distribution of the energy on the spectrums. In this case, the determining unit 202 is specifically configured to determine a demarcation frequency of each of the N audio frames. The determining unit 202 is specifically configured to determine a band-limited sparseness parameter according to the demarcation frequency of each of the N audio frames.

A person skilled in the art may understand that, the fourth preset proportion and the fourteenth preset value may be determined according to a simulation experiment. An appropriate preset value and preset proportion may be determined according to a simulation experiment, so that a good encoding effect can be obtained when an audio frame meeting the foregoing condition is encoded by using the first encoding method.

For example, the determining unit 202 may determine energy of each of P spectral envelopes of the current audio frame, and search for a demarcation frequency from a low frequency to a high frequency in a manner that a proportion that energy that is less than the demarcation frequency accounts for in total energy of the current audio frame is the fourth preset proportion. The band-limited sparseness parameter may be an average value of the demarcation frequencies of the N audio frames. In this case, the determining unit 202 is specifically configured to: when it is determined that the band-limited sparseness parameter of the audio frames is less than a fourteenth preset value, determine to use the first encoding method to encode the current audio frame. Assuming that N is 1, the demarcation frequency of the current audio frame is the band-limited sparseness parameter. Assuming that N is an integer greater than 1, the determining unit 202 may determine that the average value of the demarcation frequencies of the N audio frames is the band-limited sparseness parameter. A person skilled in the art may understand that, the demarcation frequency determining mentioned above is merely an example. Alternatively, the demarcation frequency determining method may be searching for a demarcation frequency from a high frequency to a low frequency or may be another method.

Further, to avoid frequent switching between the first encoding method and the second encoding method, the determining unit 202 may be further configured to set a hangover period. The determining unit 202 may be configured to: for an audio frame in the hangover period, use an encoding method used for an audio frame at a start position of the hangover period. In this way, a switching quality decrease caused by frequent switching between different encoding methods can be avoided.

If a hangover length of the hangover period is L, the determining unit 202 may be configured to determine that L audio frames after the current audio frame all belong to a hangover period of the current audio frame. If sparseness of distribution, on a spectrum, of energy of an audio frame belonging the hangover period is different from sparseness of distribution, on a spectrum, of energy of an audio frame at a start position of the hangover period, the determining unit 202 may be configured to determine that the audio frame is still encoded by using an encoding method that is the same as that used for the audio frame at the start position of the hangover period.

The hangover period length may be updated according to sparseness of distribution, on a spectrum, of energy of an audio frame in the hangover period, until the hangover period length is 0.

For example, if the determining unit 202 determines to use the first encoding method for an $I^{th}$ audio frame and a length of a preset hangover period is L, the determining unit 202 may determine that the first encoding method is used for an $(I+1)^{th}$ audio frame to an $(I+L)^{th}$ audio frame. Then, the determining unit 202 may determine sparseness of distribution, on a spectrum, of energy of the $(I+1)^{th}$ audio frame, and re-calculate the hangover period according to the sparseness of distribution, on the spectrum, of the energy of the $(I+1)^{th}$ audio frame. If the $(I+1)^{th}$ audio frame still meets a condition of using the first encoding method, the determining unit 202 may determine that a subsequent hangover period is still the preset hangover period L. That is, the hangover period starts from an $(L+2)^{th}$ audio frame to an $(I+1+L)^{th}$ audio frame. If the $(I+1)^{th}$ audio frame does not meet the condition of using the first encoding method, the determining unit 202 may re-determine the hangover period according to the sparseness of distribution, on the spectrum, of the energy of the $(I+1)^{th}$ audio frame. For example, the determining unit 202 may re-determine that the hangover period is L−L1, where L1 is a positive integer less than or equal to L. If L1 is equal to L, the hangover period length is updated to 0. In this case, the determining unit 202 may re-determine the encoding method according to the sparseness of distribution, on the spectrum, of the energy of the $(I+1)^{th}$ audio frame. If L1 is an integer less than L, the determining unit 202 may re-determine the encoding method according to sparseness of distribution, on a spectrum, of energy of an $(I+1+L-L1)^{th}$ audio frame. However, because the $(I+1)^{th}$ audio frame is in a hangover period of the $I^{th}$ audio frame, the $(I+1)^{th}$ audio frame is still encoded by using the first encoding method. L1 may be referred to as a hangover update parameter, and a value of the hangover update parameter may be determined according to sparseness of distribution, on a spectrum, of energy of an input audio frame. In this way, hangover period update is related to sparseness of distribution, on a spectrum, of energy of an audio frame.

For example, when a general sparseness parameter is determined and the general sparseness parameter is a first minimum bandwidth, the determining unit 202 may re-determine the hangover period according to a minimum bandwidth of distribution, on a spectrum, of first-preset-proportion energy of an audio frame. It is assumed that it is determined to use the first encoding method to encode the $I^{th}$ audio frame, and a preset hangover period is L. The determining unit 202 may determine a minimum bandwidth of distribution, on a spectrum, of first-preset-proportion energy of each of H consecutive audio frames including the $(I+1)^{th}$ audio frame, where H is a positive integer greater than 0. If the $(I+1)^{th}$ audio frame does not meet the condition of using the first encoding method, the determining unit 202 may determine a quantity of audio frames whose minimum bandwidths, distributed on spectrums, of first-preset-proportion energy are less than a fifteenth preset value (the quantity is briefly referred to as a first hangover parameter). When a minimum bandwidth of distribution, on a spectrum, of first-preset-proportion energy of an $(L+1)^{th}$ audio frame is greater than a sixteenth preset value and is less than a seventeenth preset value, and the first hangover parameter is less than an eighteenth preset value, the determining unit 202 may subtract the hangover period length by 1, that is, the hangover update parameter is 1. The sixteenth preset value is greater than the first preset value. When the minimum bandwidth of distribution, on the spectrum, of the first-preset-proportion energy of the $(L+1)^{th}$ audio frame is greater than the seventeenth preset value and is less than a nineteenth preset value, and the first hangover parameter is less than the eighteenth preset value, the determining unit 202 may subtract the hangover period length by 2, that is, the hangover update parameter is 2. When the minimum bandwidth of distribution, on the spectrum, of the first-preset-proportion energy of the $(L+1)^{th}$ audio frame is greater than the nineteenth preset value, the determining unit 202 may set the hangover period to 0. When the first hangover parameter and the minimum bandwidth of distribution, on the spectrum, of the first-preset-proportion energy of the $(L+1)^{th}$ audio frame do not meet one or more of the sixteenth preset value to the nineteenth preset value, the determining unit 202 may determine that the hangover period remains unchanged.

A person skilled in the art may understand that, the preset hangover period may be set according to an actual status, and the hangover update parameter also may be adjusted according to an actual status. The fifteenth preset value to the nineteenth preset value may be adjusted according to an actual status, so that different hangover periods may be set.

Similarly, when the general sparseness parameter includes a second minimum bandwidth and a third minimum bandwidth, or the general sparseness parameter includes a first energy proportion, or the general sparseness parameter includes a second energy proportion and a third energy proportion, the determining unit 202 may set a corresponding preset hangover period, a corresponding hangover update parameter, and a related parameter used to determine the hangover update parameter, so that a corresponding hangover period can be determined, and frequent switching between encoding methods is avoided.

When the encoding method is determined according to the burst sparseness (that is, the encoding method is determined according to global sparseness, local sparseness, and short-time burstiness of distribution, on a spectrum, of energy of an audio frame), the determining unit 202 may set a corresponding hangover period, a corresponding hangover update parameter, and a related parameter used to determine the hangover update parameter, to avoid frequent switching between encoding methods. In this case, the hangover period may be less than the hangover period that is set in the case of the general sparseness parameter.

When the encoding method is determined according to a band-limited characteristic of distribution of energy on a spectrum, the determining unit 202 may set a corresponding hangover period, a corresponding hangover update parameter, and a related parameter used to determine the hangover update parameter, to avoid frequent switching between encoding methods. For example, the determining unit 202 may calculate a proportion of energy of a low spectral envelope of an input audio frame to energy of all spectral envelopes, and determine the hangover update parameter according to the proportion. Specifically, the determining unit 202 may determine the proportion of the energy of the low spectral envelope to the energy of all the spectral envelopes by using the following formula:

$$R_{low} = \frac{\sum_{k=0}^{y} s(k)}{\sum_{k=0}^{P-1} s(k)} \qquad \text{Formula 1.10}$$

where $R_{low}$ represents the proportion of the energy of the low spectral envelope to the energy of all the spectral envelopes, s(k) represents energy of a $k^{th}$ spectral envelope, y represents an index of a highest spectral envelope of a low frequency band, and P indicates that the audio frame is divided into P spectral envelopes in total. In this case, if $R_{low}$ is greater than a twentieth preset value, the hangover update parameter is 0. If $R_{low}$ is greater than a twenty-first preset value, the hangover update parameter may have a relatively small value, where the twentieth preset value is greater than the twenty-first preset value. If $R_{low}$ is not greater than the twenty-first preset value, the hangover parameter may have a relatively large value. A person skilled in the art may understand that, the twentieth preset value and the twenty-first preset value may be determined according to a simulation experiment, and the value of the hangover update parameter also may be determined according to an experiment.

In addition, when the encoding method is determined according to a band-limited characteristic of distribution of energy on a spectrum, the determining unit 202 may further determine a demarcation frequency of an input audio frame, and determine the hangover update parameter according to the demarcation frequency, where the demarcation frequency may be different from a demarcation frequency used to determine a band-limited sparseness parameter. If the demarcation frequency is less than a twenty-second preset value, the determining unit 202 may determine that the hangover update parameter is 0. If the demarcation frequency is less than a twenty-third preset value, the determining unit 202 may determine that the hangover update parameter has a relatively small value. If the demarcation frequency is greater than the twenty-third preset value, the determining unit 202 may determine that the hangover update parameter may have a relatively large value. A person skilled in the art may understand that, the twenty-second preset value and the twenty-third preset value may be determined according to a simulation experiment, and the value of the hangover update parameter also may be determined according to an experiment.

Figure 3:
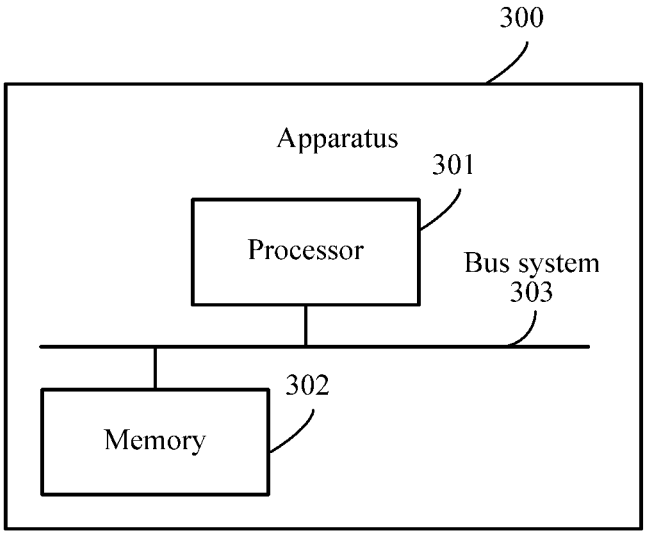
FIG. 3 is a structural block diagram of an apparatus according to an embodiment of the present invention.

FIG. 3 is a structural block diagram of an apparatus according to an embodiment of the present invention. The apparatus 300 shown in FIG. 3 can perform the steps in FIG. 1. As shown in FIG. 3, the apparatus 300 includes a processor 301 and a memory 302.

Components in the apparatus 300 are coupled by using a bus system 303. The bus system 303 further includes a power supply bus, a control bus, and a status signal bus in addition to a data bus. However, for ease of clear description, all buses are marked as the bus system 303 in FIG. 3.

The method disclosed in the foregoing embodiments of the present invention may be applied to the processor 301, or implemented by the processor 301. The processor 301 may be an integrated circuit chip and has a signal processing capability. In an implementation process, the steps of the method may be completed by using an integrated logic circuit of hardware in the processor 301 or an instruction in a software form. The processor 301 may be a general purpose processor, a digital signal processor (Digital Signal Processor, DSP), an application-specific integrated circuit (Application Specific Integrated Circuit, ASIC), a field programmable gate array (Field Programmable Gate Array, FPGA) or another programmable logical device, a discrete gate or transistor logic device, or a discrete hardware component. The processor 301 may implement or execute methods, steps and logical block diagrams disclosed in the embodiments of the present invention. The general purpose processor may be a microprocessor or the processor may be any common processor, and the like. Steps of the methods disclosed with reference to the embodiments of the present invention may be directly executed and completed by means of a hardware decoding processor, or may be executed and completed by using a combination of hardware and software modules in the decoding processor. The software module may be located in a storage medium that is mature in the art such as a random access memory (Random Access Memory, RAM), a flash memory, a read-only memory (Read-Only Memory, ROM), a programmable read-only memory or an electrically erasable programmable memory, or a register. The storage medium is located in the memory 302. The processor 301 reads the instruction from the memory 302, and completes the steps of the method in combination with hardware thereof.

The processor 301 is configured to obtain N audio frames, where the N audio frames include a current audio frame, and N is a positive integer.

The processor 301 is configured to determine sparseness of distribution, on the spectrums, of energy of the N audio frames obtained by the processor 301.

The processor 301 is further configured to determine, according to the sparseness of distribution, on the spectrums, of the energy of the N audio frames, whether to use a first encoding method or a second encoding method to encode the current audio frame, where the first encoding method is an encoding method that is based on time-frequency transform and transform coefficient quantization and that is not based on linear prediction, and the second encoding method is a linear-predication-based encoding method.

According to the apparatus shown in FIG. 3, when an audio frame is encoded, sparseness of distribution, on a spectrum, of energy of the audio frame is considered, which can reduce encoding complexity and ensure that encoding is of relatively high accuracy.

During selection of an appropriate encoding method for an audio frame, sparseness of distribution, on a spectrum, of energy of the audio frame may be considered. There may be three types of sparseness of distribution, on a spectrum, of energy of an audio frame: general sparseness, burst sparseness, and band-limited sparseness.

Optionally, in an embodiment, an appropriate encoding method may be selected for the current audio frame by using the general sparseness. In this case, the processor 301 is specifically configured to divide a spectrum of each of the N audio frames into P spectral envelopes, and determine a general sparseness parameter according to energy of the P spectral envelopes of each of the N audio frames, where P is a positive integer, and the general sparseness parameter indicates the sparseness of distribution, on the spectrums, of the energy of the N audio frames.

Specifically, an average value of minimum bandwidths, distributed on spectrums, of specific-proportion energy of N input consecutive audio frames may be defined as the general sparseness. A smaller bandwidth indicates stronger general sparseness, and a larger bandwidth indicates weaker general sparseness. In other words, stronger general sparseness indicates that energy of an audio frame is more centralized, and weaker general sparseness indicates that energy of an audio frame is more disperse. Efficiency is high when the first encoding method is used to encode an audio frame whose general sparseness is relatively strong. Therefore, an appropriate encoding method may be selected by determining general sparseness of an audio frame, to encode the audio frame. To help determine general sparseness of an audio frame, the general sparseness may be quantized to obtain a general sparseness parameter. Optionally, when N is 1, the general sparseness is a minimum bandwidth of distribution, on a spectrum, of specific-proportion energy of the current audio frame.

Optionally, in an embodiment, the general sparseness parameter includes a first minimum bandwidth. In this case, the processor 301 is specifically configured to determine an average value of minimum bandwidths of distribution, on the spectrums, of first-preset-proportion energy of the N audio frames according to the energy of the P spectral envelopes of each of the N audio frames, where the average value of the minimum bandwidths of distribution, on the spectrums, of the first-preset-proportion energy of the N audio frames is the first minimum bandwidth. The processor 301 is specifically configured to: when the first minimum bandwidth is less than a first preset value, determine to use the first encoding method to encode the current audio frame; and when the first minimum bandwidth is greater than the first preset value, determine to use the second encoding method to encode the current audio frame.

A person skilled in the art may understand that, the first preset value and the first preset proportion may be determined according to a simulation experiment. An appropriate first preset value and first preset proportion may be determined by means of a simulation experiment, so that a good encoding effect can be obtained when an audio frame meeting the foregoing condition is encoded by using the first encoding method or the second encoding method.

The processor 301 is specifically configured to: sort the energy of the P spectral envelopes of each audio frame in descending order; determine, according to the energy, sorted in descending order, of the P spectral envelopes of each of the N audio frames, a minimum bandwidth of distribution, on the spectrum, of energy that accounts for not less than the first preset proportion of each of the N audio frames; and determine, according to the minimum bandwidth of distribution, on the spectrum, of the energy that accounts for not less than the first preset proportion of each of the N audio frames, an average value of minimum bandwidths of distribution, on the spectrums, of energy that accounts for not less than the first preset proportion of the N audio frames. For example, an audio signal obtained by the processor 301 is a wideband signal sampled at 16 kHz, and the obtained audio signal is obtained in a frame of 30 ms. Each frame of signal is 330 time domain sampling points. The processor 301 may perform time-frequency transform on a time domain signal, for example, perform time-frequency transform by means of fast Fourier transform (Fast Fourier Transformation, FFT), to obtain 130 spectral envelopes S(k), that is, 130 FFT energy spectrum coefficients, where k=0, 1, 2, . . . , 129. The processor 301 may find a minimum bandwidth from the spectral envelopes S(k) in a manner that a proportion that energy on the bandwidth accounts for in total energy of the frame is the first preset proportion. Specifically, the processor 301 may sequentially accumulate energy of frequency bins in the spectral envelopes S(k) in descending order; and compare energy obtained after each time of accumulation with the total energy of the audio frame, and if a proportion is greater than the first preset proportion, end the accumulation process, where a quantity of times of accumulation is the minimum bandwidth. For example, the first preset proportion is 90%, and if a proportion that an energy sum obtained after 30 times of accumulation accounts for in the total energy exceeds 90%, it may be considered that a minimum bandwidth of energy that accounts for not less than the first preset proportion of the audio frame is 30. The processor 301 may execute the foregoing minimum bandwidth determining process for each of the N audio frames, to separately determine the minimum bandwidths of the energy that accounts for not less than the first preset proportion of the N audio frames including the current audio frame. The processor 301 may calculate an average value of the minimum bandwidths of the energy that accounts for not less than the first preset proportion of the N audio frames. The average value of the minimum bandwidths of the energy that accounts for not less than the first preset proportion of the N audio frames may be referred to as the first minimum bandwidth, and the first minimum bandwidth may be used as the general sparseness parameter. When the first minimum bandwidth is less than the first preset value, the processor 301 may determine to use the first encoding method to encode the current audio frame. When the first minimum bandwidth is greater than the first preset value, the processor 301 may determine to use the second encoding method to encode the current audio frame.

Optionally, in another embodiment, the general sparseness parameter may include a first energy proportion. In this case, the processor 301 is specifically configured to select $P_1$ spectral envelopes from the P spectral envelopes of each of the N audio frames, and determine the first energy proportion according to energy of the $P_1$ spectral envelopes of each of the N audio frames and total energy of the respective N audio frames, where $P_1$ is a positive integer less than P. The processor 301 is specifically configured to: when the first energy proportion is greater than a second preset value, determine to use the first encoding method to encode the current audio frame; and when the first energy proportion is less than the second preset value, determine to use the second encoding method to encode the current audio frame. Optionally, in an embodiment, when N is 1, the N audio frames are the current audio frame, and the processor 301 is specifically configured to determine the first energy proportion according to energy of $P_1$ spectral envelopes of the current audio frame and total energy of the current audio frame. The processor 301 is specifically configured to determine the $P_1$ spectral envelopes according to the energy of the P spectral envelopes, where energy of any one of the $P_1$ spectral envelopes is greater than energy of any one of the other spectral envelopes in the P spectral envelopes except the $P_1$ spectral envelopes.

Specifically, the processor 301 may calculate the first energy proportion by using the following formula:

$$\begin{cases} R_1 = \dfrac{\sum_{n=1}^{N} r(n)}{N} \\ r(n) = \dfrac{E_{p1}(n)}{E_{all}(n)} \end{cases} \qquad \text{Formula 1.6}$$

where $R_1$ represents the first energy proportion, $E_{p1}(n)$ represents an energy sum of $P_1$ selected spectral envelopes in an $n^{th}$ audio frame, $E_{all}(n)$ represents total energy of the $n^{th}$ audio frame, and r(n) represents a proportion that the energy of the $P_1$ spectral envelopes of the $n^{th}$ audio frame in the N audio frames accounts for in the total energy of the audio frame.

A person skilled in the art may understand that, the second preset value and selection of the $P_1$ spectral envelopes may be determined according to a simulation experiment. An appropriate second preset value, an appropriate value of $P_1$, and an appropriate method for selecting the $P_1$ spectral envelopes may be determined by means of a simulation experiment, so that a good encoding effect can be obtained when an audio frame meeting the foregoing condition is encoded by using the first encoding method or the second encoding method. Optionally, in an embodiment, the $P_1$ spectral envelopes may be $P_1$ spectral envelopes having maximum energy in the P spectral envelopes.

For example, an audio signal obtained by the processor 301 is a wideband signal sampled at 16 kHz, and the obtained audio signal is obtained in a frame of 30 ms. Each frame of signal is 330 time domain sampling points. The processor 301 may perform time-frequency transform on a time domain signal, for example, perform time-frequency transform by means of fast Fourier transform, to obtain 130 spectral envelopes S(k), where k=0, 1, 2, . . . , 159. The processor 301 may select $P_1$ spectral envelopes from the 130 spectral envelopes, and calculate a proportion that an energy sum of the $P_1$ spectral envelopes accounts for in total energy of the audio frame. The processor 301 may execute the foregoing process for each of the N audio frames, that is, calculate a proportion that an energy sum of the $P_1$ spectral envelopes of each of the N audio frames accounts for in respective total energy. The processor 301 may calculate an average value of the proportions. The average value of the proportions is the first energy proportion. When the first energy proportion is greater than the second preset value, the processor 301 may determine to use the first encoding method to encode the current audio frame. When the first energy proportion is less than the second preset value, the processor 301 may determine to use the second encoding method to encode the current audio frame. The $P_1$ spectral envelopes may be $P_1$ spectral envelopes having maximum energy in the P spectral envelopes. That is, the processor 301 is specifically configured to determine, from the P spectral envelopes of each of the N audio frames, $P_1$ spectral envelopes having maximum energy. Optionally, in an embodiment, the value of $P_1$ may be 30.

Optionally, in another embodiment, the general sparseness parameter may include a second minimum bandwidth and a third minimum bandwidth. In this case, the processor 301 is specifically configured to determine an average value of minimum bandwidths of distribution, on the spectrums, of second-preset-proportion energy of the N audio frames and determine an average value of minimum bandwidths of distribution, on the spectrums, of third-preset-proportion energy of the N audio frames according to the energy of the P spectral envelopes of each of the N audio frames, where the average value of the minimum bandwidths of distribution, on the spectrums, of the second-preset-proportion energy of the N audio frames is used as the second minimum bandwidth, the average value of the minimum bandwidths of distribution, on the spectrums, of the third-preset-proportion energy of the N audio frames is used as the third minimum bandwidth, and the second preset proportion is less than the third preset proportion. The processor 301 is specifically configured to: when the second minimum bandwidth is less than a third preset value and the third minimum bandwidth is less than a fourth preset value, determine to use the first encoding method to encode the current audio frame; when the third minimum bandwidth is less than a fifth preset value, determine to use the first encoding method to encode the current audio frame; and when the third minimum bandwidth is greater than a sixth preset value, determine to use the second encoding method to encode the current audio frame. Optionally, in an embodiment, when N is 1, the N audio frames are the current audio frame. The processor 301 may determine a minimum bandwidth of distribution, on the spectrum, of second-preset-proportion energy of the current audio frame as the second minimum bandwidth. The processor 301 may determine a minimum bandwidth of distribution, on the spectrum, of third-preset-proportion energy of the current audio frame as the third minimum bandwidth.

A person skilled in the art may understand that, the third preset value, the fourth preset value, the fifth preset value, the sixth preset value, the second preset proportion, and the third preset proportion may be determined according to a simulation experiment. Appropriate preset values and preset proportions may be determined by means of a simulation experiment, so that a good encoding effect can be obtained when an audio frame meeting the foregoing condition is encoded by using the first encoding method or the second encoding method.

The processor 301 is specifically configured to: sort the energy of the P spectral envelopes of each audio frame in descending order; determine, according to the energy, sorted in descending order, of the P spectral envelopes of each of the N audio frames, a minimum bandwidth of distribution, on the spectrum, of energy that accounts for not less than the second preset proportion of each of the N audio frames; determine, according to the minimum bandwidth of distribution, on the spectrum, of the energy that accounts for not less than the second preset proportion of each of the N audio frames, an average value of minimum bandwidths of distribution, on the spectrums, of energy that accounts for not less than the second preset proportion of the N audio frames; determine, according to the energy, sorted in descending order, of the P spectral envelopes of each of the N audio frames, a minimum bandwidth of distribution, on the spectrum, of energy that accounts for not less than the third preset proportion of each of the N audio frames; and determine, according to the minimum bandwidth of distribution, on the spectrum, of the energy that accounts for not less than the third preset proportion of each of the N audio frames, an average value of minimum bandwidths of distribution, on the spectrums, of energy that accounts for not less than the third preset proportion of the N audio frames. For example, an audio signal obtained by the processor 301 is a wideband signal sampled at 16 kHz, and the obtained audio signal is obtained in a frame of 30 ms. Each frame of signal is 330 time domain sampling points. The processor 301 may perform time-frequency transform on a time domain signal, for example, perform time-frequency transform by means of fast Fourier transform, to obtain 130 spectral envelopes S(k), where k=0, 1, 2, . . . , 159. The processor 301 may find a minimum bandwidth from the spectral envelopes S(k) in a manner that a proportion that energy on the bandwidth accounts for in total energy of the frame is not less than the second preset proportion. The processor 301 may continue to find a bandwidth from the spectral envelopes S(k) in a manner that a proportion that energy on the bandwidth accounts for in the total energy is not less than the third preset proportion. Specifically, the processor 301 may sequentially accumulate energy of frequency bins in the spectral envelopes S(k) in descending order. Energy obtained after each time of accumulation is compared with the total energy of the audio frame, and if a proportion is greater than the second preset proportion, a quantity of times of accumulation is a minimum bandwidth that is not less than the second preset proportion. The processor 301 may continue the accumulation. If a proportion of energy obtained after accumulation to the total energy of the audio frame is greater than the third preset proportion, the accumulation is ended, and a quantity of times of accumulation is a minimum bandwidth that is not less than the third preset proportion. For example, the second preset proportion is 85%, and the third preset proportion is 95%. If a proportion that an energy sum obtained after 30 times of accumulation accounts for in the total energy exceeds 85%, it may be considered that the minimum bandwidth of distribution, on the spectrum, of the energy that accounts for not less than the second preset proportion of the audio frame is 30. The accumulation is continued, and if a proportion that an energy sum obtained after 35 times of accumulation accounts for in the total energy is 95%, it may be considered that the minimum bandwidth of distribution, on the spectrum, of the energy that accounts for not less than the third preset proportion of the audio frame is 35. The processor 301 may execute the foregoing process for each of the N audio frames. The processor 301 may separately determine the minimum bandwidths of distribution, on the spectrums, of the energy that accounts for not less than the second preset proportion of the N audio frames including the current audio frame and the minimum bandwidths of distribution, on the spectrums, of the energy that accounts for not less than the third preset proportion of the N audio frames including the current audio frame. The average value of the minimum bandwidths of distribution, on the spectrums, of the energy that accounts for not less than the second preset proportion of the N audio frames is the second minimum bandwidth. The average value of the minimum bandwidths of distribution, on the spectrums, of the energy that accounts for not less than the third preset proportion of the N audio frames is the third minimum bandwidth. When the second minimum bandwidth is less than the third preset value and the third minimum bandwidth is less than the fourth preset value, the processor 301 may determine to use the first encoding method to encode the current audio frame. When the third minimum bandwidth is less than the fifth preset value, the processor 301 may determine to use the first encoding method to encode the current audio frame. When the third minimum bandwidth is greater than the sixth preset value, the processor 301 may determine to use the second encoding method to encode the current audio frame.

Optionally, in another embodiment, the general sparseness parameter includes a second energy proportion and a third energy proportion. In this case, the processor 301 is specifically configured to: select $P_2$ spectral envelopes from the P spectral envelopes of each of the N audio frames, determine the second energy proportion according to energy of the $P_2$ spectral envelopes of each of the N audio frames and total energy of the respective N audio frames, select $P_3$ spectral envelopes from the P spectral envelopes of each of the N audio frames, and determine the third energy proportion according to energy of the $P_3$ spectral envelopes of each of the N audio frames and the total energy of the respective N audio frames, where $P_2$ and $P_3$ are positive integers less than P, and $P_2$ is less than $P_3$. The processor 301 is specifically configured to: when the second energy proportion is greater than a seventh preset value and the third energy proportion is greater than an eighth preset value, determine to use the first encoding method to encode the current audio frame; when the second energy proportion is greater than a ninth preset value, determine to use the first encoding method to encode the current audio frame; and when the third energy proportion is less than a tenth preset value, determine to use the second encoding method to encode the current audio frame. Optionally, in an embodiment, when N is 1, the N audio frames are the current audio frame. The processor 301 may determine the second energy proportion according to energy of $P_2$ spectral envelopes of the current audio frame and total energy of the current audio frame. The processor 301 may determine the third energy proportion according to energy of $P_3$ spectral envelopes of the current audio frame and the total energy of the current audio frame.

A person skilled in the art may understand that, values of $P_2$ and $P_3$, the seventh preset value, the eighth preset value, the ninth preset value, and the tenth preset value may be determined according to a simulation experiment. Appropriate preset values may be determined by means of a simulation experiment, so that a good encoding effect can be obtained when an audio frame meeting the foregoing condition is encoded by using the first encoding method or the second encoding method. Optionally, in an embodiment, the processor 301 is specifically configured to determine, from the P spectral envelopes of each of the N audio frames, $P_2$ spectral envelopes having maximum energy, and determine, from the P spectral envelopes of each of the N audio frames, $P_3$ spectral envelopes having maximum energy.

For example, an audio signal obtained by the processor 301 is a wideband signal sampled at 16 kHz, and the obtained audio signal is obtained in a frame of 30 ms. Each frame of signal is 330 time domain sampling points. The processor 301 may perform time-frequency transform on a time domain signal, for example, perform time-frequency transform by means of fast Fourier transform, to obtain 130 spectral envelopes S(k), where k=0, 1, 2, . . . , 159. The processor 301 may select $P_2$ spectral envelopes from the 130 spectral envelopes, and calculate a proportion that an energy sum of the $P_2$ spectral envelopes accounts for in total energy of the audio frame. The processor 301 may execute the foregoing process for each of the N audio frames, that is, calculate a proportion that an energy sum of the $P_2$ spectral envelopes of each of the N audio frames accounts for in respective total energy. The processor 301 may calculate an average value of the proportions. The average value of the proportions is the second energy proportion. The processor 301 may select $P_3$ spectral envelopes from the 130 spectral envelopes, and calculate a proportion that an energy sum of the $P_3$ spectral envelopes accounts for in the total energy of the audio frame. The processor 301 may execute the foregoing process for each of the N audio frames, that is, calculate a proportion that an energy sum of the $P_3$ spectral envelopes of each of the N audio frames accounts for in the respective total energy. The processor 301 may calculate an average value of the proportions. The average value of the proportions is the third energy proportion. When the second energy proportion is greater than the seventh preset value and the third energy proportion is greater than the eighth preset value, the processor 301 may determine to use the first encoding method to encode the current audio frame. When the second energy proportion is greater than the ninth preset value, the processor 301 may determine to use the first encoding method to encode the current audio frame. When the third energy proportion is less than the tenth preset value, the processor 301 may determine to use the second encoding method to encode the current audio frame. The $P_2$ spectral envelopes may be $P_2$ spectral envelopes having maximum energy in the P spectral envelopes; and the $P_3$ spectral envelopes may be $P_3$ spectral envelopes having maximum energy in the P spectral envelopes. Optionally, in an embodiment, the value of $P_2$ may be 30, and the value of $P_3$ may be 30.

Optionally, in another embodiment, an appropriate encoding method may be selected for the current audio frame by using the burst sparseness. For the burst sparseness, global sparseness, local sparseness, and short-time burstiness of distribution, on a spectrum, of energy of an audio frame need to be considered. In this case, the sparseness of distribution of the energy on the spectrums may include global sparseness, local sparseness, and short-time burstiness of distribution of the energy on the spectrums. In this case, a value of N may be 1, and the N audio frames are the current audio frame. The processor 301 is specifically configured to divide a spectrum of the current audio frame into Q sub bands, and determine a burst sparseness parameter according to peak energy of each of the Q sub bands of the spectrum of the current audio frame, where the burst sparseness parameter is used to indicate global sparseness, local sparseness, and short-time burstiness of the current audio frame.

Specifically, the processor 301 is specifically configured to determine a global peak-to-average proportion of each of the Q sub bands, a local peak-to-average proportion of each of the Q sub bands, and a short-time energy fluctuation of each of the Q sub bands, where the global peak-to-average proportion is determined by the processor 301 according to the peak energy in the sub band and average energy of all the sub bands of the current audio frame, the local peak-to-average proportion is determined by the processor 301 according to the peak energy in the sub band and average energy in the sub band, and the short-time peak energy fluctuation is determined according to the peak energy in the sub band and peak energy in a specific frequency band of an audio frame before the audio frame. The global peak-to-average proportion of each of the Q sub bands, the local peak-to-average proportion of each of the Q sub bands, and the short-time energy fluctuation of each of the Q sub bands respectively represent the global sparseness, the local sparseness, and the short-time burstiness. The processor 301 is specifically configured to: determine whether there is a first sub band in the Q sub bands, where a local peak-to-average proportion of the first sub band is greater than an eleventh preset value, a global peak-to-average proportion of the first sub band is greater than a twelfth preset value, and a short-time peak energy fluctuation of the first sub band is greater than a thirteenth preset value; and when there is the first sub band in the Q sub bands, determine to use the first encoding method to encode the current audio frame.

Specifically, the processor 301 may calculate the global peak-to-average proportion by using the following formula:

$$p2s(i) = e(i)/\left(\frac{1}{P} * \sum_{k=0}^{P-1} s(k)\right) \quad \text{Formula 1.7}$$

where e(i) represents peak energy of an $i^{th}$ sub band in the Q sub bands, s(k) represents energy of a $k^{th}$ spectral envelope in the P spectral envelopes, and p2s(i) represents a global peak-to-average proportion of the $i^{th}$ sub band.

The processor 301 may calculate the local peak-to-average proportion by using the following formula:

$$p2a(i) = e(i)/\left(\frac{1}{h(i) - 1(i) + 1} * \sum_{k=1(i)}^{h(i)} s(k)\right) \quad \text{Formula 1.8}$$

where e(i) represents the peak energy of the $i^{th}$ sub band in the Q sub bands, s(k) represents the energy of the $k^{th}$ spectral envelope in the P spectral envelopes, h(i) represents an index of a spectral envelope that is included in the $i^{th}$ sub band and that has a highest frequency, l(i) represents an index of a spectral envelope that is included in the $i^{th}$ sub band and that has a lowest frequency, p2a(i) represents a local peak-to-average proportion of the $i^{th}$ sub band, and h(i) is less than or equal to P−1.

The processor 301 may calculate the short-time peak energy fluctuation by using the following formula:

$$dev(i)=(2*e(i))/(e_1+e_2) \quad \text{Formula 1.9}$$

where e(i) represents the peak energy of the $i^{th}$ sub band in the Q sub bands of the current audio frame, and $e_1$ and $e_2$ represent peak energy of specific frequency bands of audio frames before the current audio frame. Specifically, assuming that the current audio frame is an $M^{th}$ audio frame, a spectral envelope in which peak energy of the $i^{th}$ sub band of the current audio frame is located is determined. It is assumed that the spectral envelope in which the peak energy is located is $i_1$. Peak energy within a range from an $(i_1-t)^{th}$ spectral envelope to an $(i_1+t)^{th}$ spectral envelope in an $(M-1)^{th}$ audio frame is determined, and the peak energy is $e_1$. Similarly, peak energy within a range from an $(i_1-t)^{th}$ spectral envelope to an $(i_1+t)^{th}$ spectral envelope in an $(M-2)^{th}$ audio frame is determined, and the peak energy is $e_2$.

A person skilled in the art may understand that, the eleventh preset value, the twelfth preset value, and the thirteenth preset value may be determined according to a simulation experiment. Appropriate preset values may be determined by means of a simulation experiment, so that a good encoding effect can be obtained when an audio frame meeting the foregoing condition is encoded by using the first encoding method.

Optionally, in another embodiment, an appropriate encoding method may be selected for the current audio frame by using the band-limited sparseness. In this case, the sparseness of distribution of the energy on the spectrums includes band-limited sparseness of distribution of the energy on the spectrums. In this case, the processor 301 is specifically configured to determine a demarcation frequency of each of the N audio frames. The processor 301 is specifically configured to determine a band-limited sparseness parameter according to the demarcation frequency of each of the N audio frames.

A person skilled in the art may understand that, the fourth preset proportion and the fourteenth preset value may be determined according to a simulation experiment. An appropriate preset value and preset proportion may be determined according to a simulation experiment, so that a good encoding effect can be obtained when an audio frame meeting the foregoing condition is encoded by using the first encoding method.

For example, the processor 301 may determine energy of each of P spectral envelopes of the current audio frame, and search for a demarcation frequency from a low frequency to a high frequency in a manner that a proportion that energy that is less than the demarcation frequency accounts for in total energy of the current audio frame is the fourth preset proportion. The band-limited sparseness parameter may be an average value of the demarcation frequencies of the N audio frames. In this case, the processor 301 is specifically configured to: when it is determined that the band-limited sparseness parameter of the audio frames is less than a fourteenth preset value, determine to use the first encoding method to encode the current audio frame. Assuming that N is 1, the demarcation frequency of the current audio frame is the band-limited sparseness parameter. Assuming that N is an integer greater than 1, the processor 301 may determine that the average value of the demarcation frequencies of the N audio frames is the band-limited sparseness parameter. A person skilled in the art may understand that, the demarcation frequency determining mentioned above is merely an example. Alternatively, the demarcation frequency determining method may be searching for a demarcation frequency from a high frequency to a low frequency or may be another method.

Further, to avoid frequent switching between the first encoding method and the second encoding method, the processor 301 may be further configured to set a hangover period. The processor 301 may be configured to: for an audio frame in the hangover period, use an encoding method used for an audio frame at a start position of the hangover period. In this way, a switching quality decrease caused by frequent switching between different encoding methods can be avoided.

If a hangover length of the hangover period is L, the processor 301 may be configured to determine that L audio frames after the current audio frame all belong to a hangover period of the current audio frame. If sparseness of distribution, on a spectrum, of energy of an audio frame belonging the hangover period is different from sparseness of distribution, on a spectrum, of energy of an audio frame at a start position of the hangover period, the processor 301 may be configured to determine that the audio frame is still encoded by using an encoding method that is the same as that used for the audio frame at the start position of the hangover period.

The hangover period length may be updated according to sparseness of distribution, on a spectrum, of energy of an audio frame in the hangover period, until the hangover period length is 0.

For example, if the processor 301 determines to use the first encoding method for an $I^{th}$ audio frame and a length of a preset hangover period is L, the processor 301 may determine that the first encoding method is used for an $(I+1)^{th}$ audio frame to an $(I+L)^{th}$ audio frame. Then, the processor 301 may determine sparseness of distribution, on a spectrum, of energy of the $(I+1)^{th}$ audio frame, and re-calculate the hangover period according to the sparseness of distribution, on the spectrum, of the energy of the $(I+1)^{th}$ audio frame. If the $(I+1)^{th}$ audio frame still meets a condition of using the first encoding method, the processor 301 may determine that a subsequent hangover period is still the preset hangover period L. That is, the hangover period starts from an $(L+2)^{th}$ audio frame to an $(I+1+L)^{th}$ audio frame. If the $(I+1)^{th}$ audio frame does not meet the condition of using the first encoding method, the processor 301 may re-determine the hangover period according to the sparseness of distribution, on the spectrum, of the energy of the $(I+1)^{th}$ audio frame. For example, the processor 301 may re-determine that the hangover period is L−L1, where L1 is a positive integer less than or equal to L. If L1 is equal to L, the hangover period length is updated to 0. In this case, the processor 301 may re-determine the encoding method according to the sparseness of distribution, on the spectrum, of the energy of the $(I+1)^{th}$ audio frame. If L1 is an integer less than L, the processor 301 may re-determine the encoding method according to sparseness of distribution, on a spectrum, of energy of an $(I+1+L-L1)^{th}$ audio frame. However, because the $(I+1)^{th}$ audio frame is in a hangover period of the $I^{th}$ audio frame, the $(I+1)^{th}$ audio frame is still encoded by using the first encoding method. L1 may be referred to as a hangover update parameter, and a value of the hangover update parameter may be determined according to sparseness of distribution, on a spectrum, of energy of an input audio frame. In this way, hangover period update is related to sparseness of distribution, on a spectrum, of energy of an audio frame.

For example, when a general sparseness parameter is determined and the general sparseness parameter is a first minimum bandwidth, the processor 301 may re-determine the hangover period according to a minimum bandwidth of distribution, on a spectrum, of first-preset-proportion energy of an audio frame. It is assumed that it is determined to use the first encoding method to encode the $I^{th}$ audio frame, and a preset hangover period is L. The processor 301 may determine a minimum bandwidth of distribution, on a spectrum, of first-preset-proportion energy of each of H consecutive audio frames including the $(I+1)^{th}$ audio frame, where H is a positive integer greater than 0. If the $(I+1)^{th}$ audio frame does not meet the condition of using the first encoding method, the processor 301 may determine a quantity of audio frames whose minimum bandwidths, distributed on spectrums, of first-preset-proportion energy are less than a fifteenth preset value (the quantity is briefly referred to as a first hangover parameter). When a minimum bandwidth of distribution, on a spectrum, of first-preset-proportion energy of an $(L+1)^{th}$ audio frame is greater than a sixteenth preset value and is less than a seventeenth preset value, and the first hangover parameter is less than an eighteenth preset value, the processor 301 may subtract the hangover period length by 1, that is, the hangover update parameter is 1. The sixteenth preset value is greater than the first preset value. When the minimum bandwidth of distribution, on the spectrum, of the first-preset-proportion energy of the $(L+1)^{th}$ audio frame is greater than the seventeenth preset value and is less than a nineteenth preset value, and the first hangover parameter is less than the eighteenth preset value, the processor 301 may subtract the hangover period length by 2, that is, the hangover update parameter is 2. When the minimum bandwidth of distribution, on the spectrum, of the first-preset-proportion energy of the $(L+1)^{th}$ audio frame is greater than the nineteenth preset value, the processor 301 may set the hangover period to 0. When the first hangover parameter and the minimum bandwidth of distribution, on the spectrum, of the first-preset-proportion energy of the $(L+1)^{th}$ audio frame do not meet one or more of the sixteenth preset value to the nineteenth preset value, the processor 301 may determine that the hangover period remains unchanged.

A person skilled in the art may understand that, the preset hangover period may be set according to an actual status, and the hangover update parameter also may be adjusted according to an actual status. The fifteenth preset value to the nineteenth preset value may be adjusted according to an actual status, so that different hangover periods may be set.

Similarly, when the general sparseness parameter includes a second minimum bandwidth and a third minimum bandwidth, or the general sparseness parameter includes a first energy proportion, or the general sparseness parameter includes a second energy proportion and a third energy proportion, the processor 301 may set a corresponding preset hangover period, a corresponding hangover update parameter, and a related parameter used to determine the hangover update parameter, so that a corresponding hangover period can be determined, and frequent switching between encoding methods is avoided.

When the encoding method is determined according to the burst sparseness (that is, the encoding method is determined according to global sparseness, local sparseness, and short-time burstiness of distribution, on a spectrum, of energy of an audio frame), the processor 301 may set a corresponding hangover period, a corresponding hangover update parameter, and a related parameter used to determine the hangover update parameter, to avoid frequent switching between encoding methods. In this case, the hangover period may be less than the hangover period that is set in the case of the general sparseness parameter.

When the encoding method is determined according to a band-limited characteristic of distribution of energy on a spectrum, the processor 301 may set a corresponding hangover period, a corresponding hangover update parameter, and a related parameter used to determine the hangover update parameter, to avoid frequent switching between encoding methods. For example, the processor 301 may calculate a proportion of energy of a low spectral envelope of an input audio frame to energy of all spectral envelopes, and determine the hangover update parameter according to the proportion. Specifically, the processor 301 may determine the proportion of the energy of the low spectral envelope to the energy of all the spectral envelopes by using the following formula:

$$R_{low} = \frac{\sum_{k=0}^{y} s(k)}{\sum_{k=0}^{P-1} s(k)} \qquad \text{Formula 1.10}$$

where $R_{low}$ represents the proportion of the energy of the low spectral envelope to the energy of all the spectral envelopes, s(k) represents energy of a $k^{th}$ spectral envelope, y represents an index of a highest spectral envelope of a low frequency band, and P indicates that the audio frame is divided into P spectral envelopes in total. In this case, if $R_{low}$ is greater than a twentieth preset value, the hangover update parameter is 0. If $R_{low}$ is greater than a twenty-first preset value, the hangover update parameter may have a relatively small value, where the twentieth preset value is greater than the twenty-first preset value. If $R_{low}$ is not greater than the twenty-first preset value, the hangover parameter may have a relatively large value. A person skilled in the art may understand that, the twentieth preset value and the twenty-first preset value may be determined according to a simulation experiment, and the value of the hangover update parameter also may be determined according to an experiment.

In addition, when the encoding method is determined according to a band-limited characteristic of distribution of energy on a spectrum, the processor 301 may further determine a demarcation frequency of an input audio frame, and determine the hangover update parameter according to the demarcation frequency, where the demarcation frequency may be different from a demarcation frequency used to determine a band-limited sparseness parameter. If the demarcation frequency is less than a twenty-second preset value, the processor 301 may determine that the hangover update parameter is 0. If the demarcation frequency is less than a twenty-third preset value, the processor 301 may determine that the hangover update parameter has a relatively small value. If the demarcation frequency is greater than the twenty-third preset value, the processor 301 may determine that the hangover update parameter may have a relatively large value. A person skilled in the art may understand that, the twenty-second preset value and the twenty-third preset value may be determined according to a simulation experiment, and the value of the hangover update parameter also may be determined according to an experiment.

A person of ordinary skill in the art may be aware that, in combination with the examples described in the embodiments disclosed in this specification, units and algorithm steps may be implemented by electronic hardware or a combination of computer software and electronic hardware. Whether the functions are performed by hardware or software depends on particular applications and design constraint conditions of the technical solutions. A person skilled in the art may use different methods to implement the described functions for each particular application, but it should not be considered that the implementation goes beyond the scope of the present invention.

It may be clearly understood by a person skilled in the art that, for the purpose of convenient and brief description, for a detailed working process of the foregoing system, apparatus, and unit, reference may be made to a corresponding process in the foregoing method embodiments, and details are not described herein.

In the several embodiments provided in the present application, it should be understood that the disclosed system, apparatus, and method may be implemented in other manners. For example, the described apparatus embodiment is merely exemplary. For example, the unit division is merely logical function division and may be other division in actual implementation. For example, a plurality of units or components may be combined or integrated into another system, or some features may be ignored or not performed. In addition, the displayed or discussed mutual couplings or direct couplings or communication connections may be implemented through some interfaces. The indirect couplings or communication connections between the apparatuses or units may be implemented in electronic, mechanical, or other forms.

The units described as separate parts may or may not be physically separate, and parts displayed as units may or may not be physical units, may be located in one position, or may be distributed on a plurality of network units. A part or all of the units may be selected according to actual needs to achieve the objectives of the solutions of the embodiments.

In addition, functional units in the embodiments of the present invention may be integrated into one processing unit, or each of the units may exist alone physically, or two or more units are integrated into one unit.

When the functions are implemented in a form of a software functional unit and sold or used as an independent product, the functions may be stored in a computer-readable storage medium. Based on such an understanding, the technical solutions of the present invention essentially, or the part contributing to the prior art, or a part of the technical solutions may be implemented in a form of a software product. The software product is stored in a storage medium and includes several instructions for instructing a computer device (which may be a personal computer, a server, or a network device) or a processor to perform all or a part of the steps of the methods described in the embodiments of the present invention. The foregoing storage medium includes: any medium that can store program code, such as a USB flash drive, a removable hard disk, a read-only memory (ROM, Read-Only Memory), a random access memory (RAM, Random Access Memory), a magnetic disk, or an optical disc.

The foregoing descriptions are merely specific embodiments of the present invention, but are not intended to limit the protection scope of the present invention. Any variation or replacement readily figured out by a person skilled in the art within the technical scope disclosed in the present invention shall fall within the protection scope of the present invention. Therefore, the protection scope of the present invention shall be subject to the protection scope of the claims.

What is claimed is:

1. An audio encoding method, comprising:

dividing an energy spectrum of each of N audio frames into P fast Fourier transform (FFT) energy spectrum coefficients, wherein P and N are positive integers, and the N audio frames comprise a current audio frame;

determining a general sparseness parameter according to energy of the P FFT energy spectrum coefficients of each of the N audio frames by determining an average value of minimum bandwidths of distribution on spectrums of a first preset proportion of energy of the N audio frames according to the energy of the P FFT energy spectrum coefficients of each of the N audio frames, wherein the general sparseness parameter comprises a first minimum bandwidth, wherein the average value of the minimum bandwidths of the distribution on spectrums of the first preset proportion of the energy of the N audio frames is used as the first minimum bandwidth, and wherein the general sparseness parameter indicates sparseness of distribution in energy spectrums of the N audio frames; and determining, based on the sparseness of distribution, whether to use a first encoding method or a second encoding method to encode the current audio frame, wherein the first encoding method is based on time-frequency transform and transform coefficient quantization, and the second encoding method is a linear-predication-based encoding method, and wherein the first encoding method is determined to be used to encode the current audio frame based on a condition that the first minimum bandwidth is less than a first preset value, or the second encoding method is determined to be used to encode the current audio frame based on a condition that the first minimum bandwidth is greater than the first preset value.

2. The method according to claim 1, wherein the determining the average value of minimum bandwidths of the first preset proportion of the energy of the N audio frames comprises:

sorting the energy of the P FFT energy spectrum coefficients of each audio frame in descending order;

comparing energy obtained after each time of accumulation with the total energy of the audio frame, and if a proportion is greater than the first preset proportion, ending the accumulation process, where a quantity of times of accumulation is the minimum bandwidth; and determining the average value of minimum bandwidths according to the minimum bandwidth of distribution, on the spectrum, of the energy that accounts for not less than the first preset proportion of each of the N audio frames.

3. The method according to claim 1, wherein the general sparseness parameter comprises a first energy proportion, and wherein the determining the general sparseness parameter comprises:

selecting $P_1$ FFT energy spectrum coefficients from the P FFT energy spectrum coefficients of each of the N audio frames; and determining the first energy proportion according to energy of the $P_1$ FFT energy spectrum coefficients of each of the N audio frames and total energy of the N audio frames, wherein $P_1$ is a positive integer less than P, wherein the first encoding method is determined to be used to encode the current audio frame based on a condition that the first energy proportion is greater than a second preset value, or the second encoding method is determined to be used to encode the current audio frame based on a condition that the first energy proportion is less than the second preset value.

4. The method according to claim 3, wherein energy of any one of the $P_1$ FFT energy spectrum coefficients is greater than energy of any one of FFT energy spectrum coefficients in the P FFT energy spectrum coefficients other than the $P_1$ FFT energy spectrum coefficients.

5. The method according to claim 1, wherein the general sparseness parameter comprises a second minimum bandwidth and a third minimum bandwidth, and wherein the determining the general sparseness parameter comprises:

determining an average value of minimum bandwidths of distribution, on the spectrums, of a second preset proportion of the energy of the N audio frames according to the energy of the P FFT energy spectrum coefficients of each of the N audio frames; and determining an average value of minimum bandwidths of distribution, on the spectrums, of a third preset proportion of the energy of the N audio frames according to the energy of the P FFT energy spectrum coefficients of each of the N audio frames, wherein the average value of the minimum bandwidths of the second preset proportion of the energy of the N audio frames is used as the second minimum bandwidth, wherein the average value of the minimum bandwidths of the third preset proportion of the energy of the N audio frames is used as the third minimum bandwidth, wherein the second preset proportion is less than the third preset proportion, wherein the first encoding method is determined to be used to encode the current audio frame based on a condition that the second minimum bandwidth is less than a third preset value and the third minimum bandwidth is less than a fourth preset value, or the first encoding method is determined to be used to encode the current audio frame based on a condition that the third minimum bandwidth is less than a fifth preset value, or the second encoding method is determined to be used to encode the current audio frame based on a condition that the third minimum bandwidth is greater than a sixth preset value, and wherein the fourth preset value is greater than or equal to the third preset value, the fifth preset value is less than the fourth preset value, and the sixth preset value is greater than the fourth preset value.

6. The method according to claim 5, wherein the determining the average value of minimum bandwidths of the second preset proportion of the energy of the N audio frames and the determining the average value of minimum bandwidths of the third preset proportion of the energy of the N audio frames comprises:

sorting the energy of the P FFT energy spectrum coefficients of each audio frame in descending order;

determining, according to the sorted energy of the P FFT energy spectrum coefficients of each audio frame, a minimum bandwidth of distribution, on the spectrum, of energy that accounts for not less than the second preset proportion of each of the N audio frames;

determining, according to the minimum bandwidth of distribution, on the spectrum, of the energy that accounts for not less than the second preset proportion of each of the N audio frames, an average value of minimum bandwidths of distribution, on the spectrums, of energy that accounts for not less than the second preset proportion of the N audio frames;

determining, according to the energy, sorted in descending order, of the P FFT energy spectrum coefficients of each of the N audio frames, a minimum bandwidth of distribution, on the spectrum, of energy that accounts for not less than the third preset proportion of each of the N audio frames; and determining, according to the minimum bandwidth of distribution, on the spectrum, of the energy that accounts for not less than the third preset proportion of each of the N audio frames, an average value of minimum bandwidths of distribution, on the spectrums, of energy that accounts for not less than the third preset proportion of the N audio frames.

7. The method according to claim 1, wherein the general sparseness parameter comprises a second energy proportion and a third energy proportion, and wherein the determining the general sparseness parameter comprises:

determining the second energy proportion according to energy of $P_2$ FFT energy spectrum coefficients of each of the N audio frames and total energy of the N audio frames;

determining the third energy proportion according to energy of $P_3$ FFT energy spectrum coefficients of each of the N audio frames and the total energy of the N audio frames, wherein $P_2$ and $P_3$ are positive integers less than P, and $P_2$ is less than $P_3$, and wherein the first encoding method is determined to be used to encode the current audio frame based on a condition that the second energy proportion is greater than a seventh preset value and the third energy proportion is greater than an eighth preset value, or the first encoding method is determined to be used to encode the current audio frame based on a condition that the second energy proportion is greater than a ninth preset value, or the second encoding method is determined to be used to encode the current audio frame based on a condition that the third energy proportion is less than a tenth preset value.

8. The method according to claim 7, wherein the $P_2$ FFT energy spectrum coefficients have maximum energy among possible selections of $P_2$ FFT energy spectrum coefficients from the P FFT energy spectrum coefficients, and wherein the $P_3$ FFT energy spectrum coefficients have maximum energy among possible selections of $P_3$ FFT energy spectrum coefficients from the P FFT energy spectrum coefficients.

9. The method according to claim 1, wherein the N is 1.

10. The method according to claim 1, wherein the first encoding method is not based on linear prediction.

11. An audio encoder, comprising:

a memory comprising instructions; and one or more processors in communication with the memory, wherein the one or more processors execute the instructions to:

divide an energy spectrum of each of N audio frames into P fast Fourier transform (FFT) energy spectrum coefficients, wherein P and N are positive integers, and the N audio frames comprise a current audio frame;

determine a general sparseness parameter according to energy of the P FFT energy spectrum coefficients of each of the N audio frames by determining an average value of minimum bandwidths of distribution on the spectrums of a first preset proportion energy of the N audio frames according to the energy of the P FFT energy spectrum coefficients of each of the N audio frames, wherein the general sparseness parameter comprises a first minimum bandwidth, wherein the average value of the minimum bandwidths of the distribution on the spectrums of the first preset proportion of the energy of the N audio frames is used as first minimum bandwidth, and wherein the general sparseness parameter indicates sparseness of distribution in energy spectrums of the N audio frames; and determine, based on the sparseness of distribution, whether to use a first encoding method or a second encoding method to encode the current audio frame, wherein the first encoding method is based on time-frequency transform and transform coefficient quantization, and the second encoding method is a linear-predication-based encoding method, and wherein the first encoding method is determined to be used to encode the current audio frame based on a condition that the first minimum bandwidth is less than a first preset value, or the second encoding method is determined to be used to encode the current audio frame based on a condition that the first minimum bandwidth is greater than the first preset value.

12. The audio encoder according to claim 11, wherein, to determine the average value of minimum bandwidths, the one or more processors execute the instructions to:

sort the energy of the P FFT energy spectrum coefficients of each audio frame in descending order;

compare energy obtained after each time of accumulation with the total energy of the audio frame, and if a proportion is greater than the first preset proportion, end the accumulation process, where a quantity of times of accumulation is the minimum bandwidth; and determine the average value of minimum bandwidths according to the minimum bandwidth of distribution, on the spectrum, of the energy that accounts for not less than the first preset proportion of each of the N audio frames.

13. The audio encoder according to claim 11, wherein the general sparseness parameter comprises a first energy proportion, and wherein, to determine the general sparseness parameter, the one or more processors execute the instructions to: select $P_1$ FFT energy spectrum coefficients from the P FFT energy spectrum coefficients of each of the N audio frames, and determine the first energy proportion according to energy of the $P_1$ FFT energy spectrum coefficients of each of the N audio frames and total energy of the N audio frames, wherein $P_1$ is a positive integer less than P, and wherein the first encoding method is determined to be used to encode the current audio frame based on a condition that the first energy proportion is greater than a second preset value, or the second encoding method is determined to be used to encode the current audio frame based on a condition that the first energy proportion is less than the second preset value.

14. The audio encoder according to claim 13, wherein energy of any one of the $P_1$ FFT energy spectrum coefficients is greater than energy of any one of FFT energy spectrum coefficients in the P FFT energy spectrum coefficients other than the $P_1$ FFT energy spectrum coefficients.

15. The audio encoder according to claim 11, wherein the general sparseness parameter comprises a second minimum bandwidth and a third minimum bandwidth, and wherein, to determine the general sparseness parameter, the one or more processors execute the instructions to: determine an average value of minimum bandwidths of distribution, on the spectrums, of a second preset proportion of the energy of the N audio frames according to the energy of the P FFT energy spectrum coefficients of each of the N audio frames and determine an average value of minimum bandwidths of distribution, on the spectrums, of third preset proportion energy of the N audio frames according to the energy of the P FFT energy spectrum coefficients of each of the N audio frames, wherein the average value of the minimum bandwidths of the second preset proportion of the energy of the N audio frames is used as the second minimum bandwidth, the average value of the minimum bandwidths of the third preset proportion of the energy of the N audio frames is used as the third minimum bandwidth, and the second preset proportion is less than the third preset proportion, wherein the first encoding method is determined to be used to encode the current audio frame based on a condition that the second minimum bandwidth is less than a third preset value and the third minimum bandwidth is less than a fourth preset value, or the first encoding method is determined to be used to encode the current audio frame based on a condition that the third minimum bandwidth is less than a fifth preset value, or the second encoding method is determined to be used to encode the current audio frame based on a condition that the third minimum bandwidth is greater than a sixth preset value, and wherein the fourth preset value is greater than or equal to the third preset value, the fifth preset value is less than the fourth preset value, and the sixth preset value is greater than the fourth preset value.

16. The audio encoder according to claim 15, wherein, to determine the average value of minimum bandwidths, the one or more processors execute the instructions to:

sort the energy of the P FFT energy spectrum coefficients of each audio frame in descending order;

determine, according to the sorted energy of the P FFT energy spectrum coefficients of each, a minimum bandwidth of distribution, on the spectrum, of energy that accounts for not less than the second preset proportion of each of the N audio frames;

determine, according to the minimum bandwidth of distribution, on the spectrum, of the energy that accounts for not less than the second preset proportion of each of the N audio frames, an average value of minimum bandwidths of distribution, on the spectrums, of energy that accounts for not less than the second preset proportion of the N audio frames;

determine, according to the energy, sorted in descending order, of the P FFT energy spectrum coefficients of each of the N audio frames, a minimum bandwidth of distribution, on the spectrum, of energy that accounts for not less than the third preset proportion of each of the N audio frames; and determine, according to the minimum bandwidth of distribution, on the spectrum, of the energy that accounts for not less than the third preset proportion of each of the N audio frames, an average value of minimum bandwidths of distribution, on the spectrums, of energy that accounts for not less than the third preset proportion of the N audio frames.

17. The audio encoder according to claim 11, wherein the general sparseness parameter comprises a second energy proportion and a third energy proportion, and wherein to determine the general sparseness parameter, the one or more processors the execute instructions to:

determine the second energy proportion according to energy of $P_2$ FFT energy spectrum coefficients of each of the N audio frames and total energy of the respective N audio frames;

determine the third energy proportion according to energy of $P_3$ FFT energy spectrum coefficients of each of the N audio frames and the total energy of the N audio frames, wherein $P_2$ and $P_3$ are positive integers less than P, and $P_2$ is less than $P_3$; and wherein the first encoding method is determined to be used to encode the current audio frame based on a condition that the second energy proportion is greater than a seventh preset value and the third energy proportion is greater than an eighth preset value, or the first encoding method is determined to be used to encode the current audio frame based on a condition that the second energy proportion is greater than a ninth preset value, or the second encoding method is determined to be used to encode the current audio frame based on a condition that the third energy proportion is less than a tenth preset value.

18. The audio encoder according to claim 17, wherein the $P_2$ FFT energy spectrum coefficients have maximum energy among possible selections of $P_2$ FFT energy spectrum coefficients from the P FFT energy spectrum coefficients, and wherein the $P_3$ FFT energy spectrum coefficients have maximum energy among possible selections of $P_3$ FFT energy spectrum coefficients from the P FFT energy spectrum coefficients.

19. The audio encoder according to claim 11, wherein the N is 1.

20. The audio encoder according to claim 10, wherein the first encoding method is not based on linear prediction.

* * * * *